US011673391B2

(12) United States Patent
Hayashi et al.

(10) Patent No.: US 11,673,391 B2
(45) Date of Patent: Jun. 13, 2023

(54) LIQUID EJECTION HEAD

(71) Applicant: BROTHER KOGYO KABUSHIKI KAISHA, Nagoya (JP)

(72) Inventors: Hideki Hayashi, Nagoya (JP); Keita Sugiura, Toyoake (JP); Taisuke Mizuno, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/102,554

(22) Filed: Nov. 24, 2020

(65) Prior Publication Data

US 2021/0078330 A1 Mar. 18, 2021

Related U.S. Application Data

(63) Continuation of application No. 16/665,634, filed on Oct. 28, 2019, now Pat. No. 10,946,657, which is a (Continued)

(30) Foreign Application Priority Data

Jun. 30, 2016 (JP) ..... JP2016-130334

(51) Int. Cl.
*B41J 2/14* (2006.01)
*B41J 2/155* (2006.01)

(52) U.S. Cl.
CPC ..... *B41J 2/1433* (2013.01); *B41J 2/155* (2013.01); *B41J 2002/14491* (2013.01); *B41J 2202/20* (2013.01)

(58) Field of Classification Search
CPC ..... B41J 2/1433; B41J 2/155; B41J 2002/14491; B41J 2202/20
See application file for complete search history.

(56) References Cited

U.S. PATENT DOCUMENTS 6,068,367 A 5/2000 Fabbri
9,975,337 B2 5/2018 Hayashi et al.
(Continued)

FOREIGN PATENT DOCUMENTS

CN 104924762 A 9/2015
EP 652 107 A2 5/1995
(Continued)

OTHER PUBLICATIONS

Extended European Search Report issued in corresponding European Application No. 17163950.3, dated Oct. 27, 2017.
(Continued)

*Primary Examiner* — Jason S Uhlenhake
(74) *Attorney, Agent, or Firm* — Merchant & Gould P.C.

(57) ABSTRACT

A liquid ejection head, including: a first head unit; a second head unit shifted with respect to the first head unit in both of a first direction in which nozzles of the head units are arranged and a second direction orthogonal to the first direction and disposed so as to overlap the first head unit in the second direction; and a first wiring member having flexibility and drawn from the second head unit in the second direction toward the first head unit, wherein the first wiring member includes a large-width portion on which a drive circuit is mounted and a small-width portion having a width in the first direction smaller than a width of the large-width portion in the first direction, and wherein the small-width portion passes through a space existing next to the first head unit in the first direction and extends in the second direction.

6 Claims, 12 Drawing Sheets

Related U.S. Application Data continuation of application No. 16/161,730, filed on Oct. 16, 2018, now Pat. No. 10,486,423, which is a continuation of application No. 15/955,806, filed on Apr. 18, 2018, now Pat. No. 10,124,590, which is a continuation of application No. 15/472,044, filed on Mar. 28, 2017, now Pat. No. 9,975,337.

(56) References Cited

U.S. PATENT DOCUMENTS

| | | | | |
|---|---|---|---|---|
| 2002/0191051 | A1 | 12/2002 | Silverbrook | |
| 2008/0202797 | A1 | 8/2008 | Kubo | |
| 2015/0158296 | A1 | 6/2015 | Togashi | |
| 2015/0258786 | A1 | 9/2015 | Akahane et al. | |
| 2015/0258787 | A1 | 9/2015 | Togashi | |
| 2015/0258791 | A1 | 9/2015 | Togashi | |
| 2017/0028713 | A1* | 2/2017 | Choy | B41J 2/1433 |
| 2017/0050438 | A1* | 2/2017 | Fricke | B41J 2/155 |

FOREIGN PATENT DOCUMENTS

| | | | |
|---|---|---|---|
| JP | 2003-528754 | A | 9/2003 |
| JP | 2005-131875 | A | 5/2005 |
| JP | 2006248112 | | 9/2006 |
| JP | 2008-211048 | A | 9/2008 |
| JP | 2014-97644 | A | 5/2014 |
| JP | 2015-110305 | A | 6/2015 |
| JP | 2015-174391 | A | 10/2015 |
| WO | 2013/174976 | A1 | 11/2013 |
| WO | 2015-163862 | A1 | 10/2015 |
| WO | 2015-167484 | A1 | 11/2015 |

OTHER PUBLICATIONS

Office Action issued in corresponding European Patent Application No. 17163950.3, dated Apr. 29, 2020.

Office Action issued in corresponding Japanese Patent Application No. 2016-130334, dated May 26, 2020.

Office Action issued in corresponding Chinese Patent Application 201710182529.3, dated Apr. 2, 2020.

Office Action (Notice of Reasons for Refusal) issued in related Japanese Patent Application No. 2016-130334, dated Dec. 8, 2020.

Office Action (Notice of Reasons for Refusal) issued in corresponding Japanese Patent Application No. 2021-099215, dated Jun. 21, 2022.

* cited by examiner

LIQUID EJECTION HEAD

CROSS REFERENCE TO RELATED APPLICATION

This application is a continuation of U.S. patent application Ser. No. 16/665,634, filed 28 Oct. 2019, now U.S. Pat. No. 10,946,657, which is a continuation of U.S. patent application Ser. No. 16/161,730, filed Oct. 16, 2018, now U.S. Pat. No. 10,486,423, which is a continuation of U.S. patent application Ser. No. 15/955,806, filed Apr. 18, 2018, now U.S. Pat. No. 10,124,590, which is a continuation of U.S. patent application Ser. No. 15/472,044, filed Mar. 28, 2017, now U.S. Pat. No. 9,975,337, which further claim priority from Japanese Patent Application No. 2016-130334, filed on Jun. 30, 2016, and the all disclosures are herein incorporated by reference in their entirety.

BACKGROUND

Technical Field

The following disclosure relates to a liquid ejection head configured to eject a liquid.

Description of Related Art

There is known an ink-jet printer in which head-units (head modules) are arranged in two rows which are adjacent to each other. In the printer, the head units of one row and the head units of another row are shifted relative to each other such that opposite end portions of one head unit in one row overlap respectively end portions of corresponding adjacent two head units in another row. In the known printer, a TAB film is connected to each head unit. For permitting the TAB films connected to the head units in the two rows to be drawn toward the same side of the printer, the TAB film connected to each head unit in one row is narrowed so as to have a reduced width, except a portion thereof connected to the head unit, so that the narrowed portion of the TAB film passes between the corresponding adjacent two head units in another row. In other words, the wiring member of the head unit in one row is provided with a narrowed portion having a reduced width, and the wiring member is disposed so as to avoid or so as not to interfere with the adjacent two head units in another row.

SUMMARY

In the known printer, it is not clear how a drive circuit for driving the head unit is disposed. In general, the drive circuit is incorporated in the head unit or mounted on the TAB film, for instance. When the drive circuit is incorporated in the head unit, the head unit tends to be large-sized, resulting in an increase in the size of a device (e.g., printer or head) as a whole. When the drive circuit is mounted on the TAB film, the TAB film needs to have an enough width for mounting the drive circuit. If the TAB film has a large width, it undesirably becomes difficult for the TAB film to pass between the adjacent two head units. That is, it becomes difficult to dispose the TAB film so as to avoid the adjacent two head units.

An aspect of the disclosure relates to a liquid ejection head which enables the wiring member to be disposed so as to avoid adjacent head units while the drive circuit is mounted on the wiring member for reducing a size of the head unit.

In one aspect of the disclosure, the liquid ejection head includes: a first head unit configured to eject a liquid from a plurality of nozzles arranged in a first direction; a second head unit configured to eject the liquid from a plurality of nozzles arranged in the first direction, the second head unit being shifted with respect to the first head unit in both of the first direction and a second direction orthogonal to the first direction and disposed so as to overlap the first head unit in the second direction; and a first wiring member having flexibility and drawn from the second head unit in the second direction toward the first head unit, wherein the first wiring member includes a large-width portion on which a drive circuit is mounted and a small-width portion having a width in the first direction smaller than a width of the large-width portion in the first direction, and wherein the small-width portion passes through a space existing next to the first head unit in the first direction and extends in the second direction.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

There will be described one embodiment.

Overall Structure of Printer

Figure 1:
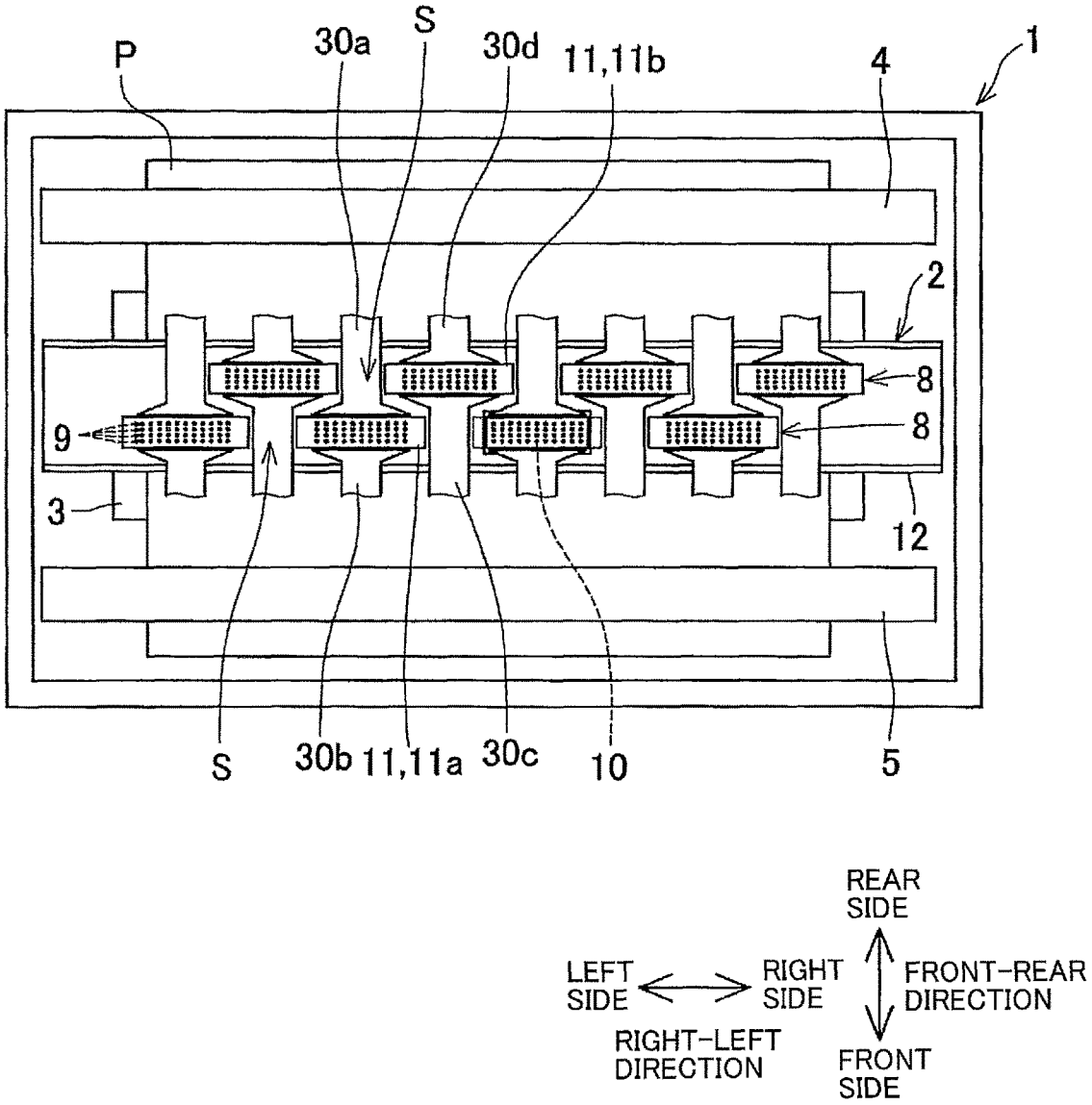
FIG. 1 is a schematic view of a printer according to one embodiment.

As shown in FIG. 1, a printer 1 includes an ink-jet head 2 (as one example of "liquid ejection head"), a platen 3, and conveyance rollers 4, 5. As shown in FIG. 1, a direction parallel to a direction in which a recording sheet P is conveyed in the printer 1 is defined as a front-rear direction, and a direction parallel to a conveyance surface of the recording sheet P and perpendicular to the front-rear direction is defined as a right-left direction. Further, as shown in FIG. 1, a front side and a rear side are defined with respect to the front-rear direction, and a right side and a left side are defined with respect to the right-left direction. Each of the front-rear direction and the right-left direction is a horizontal direction orthogonal to an up-down direction.

Figure 2:
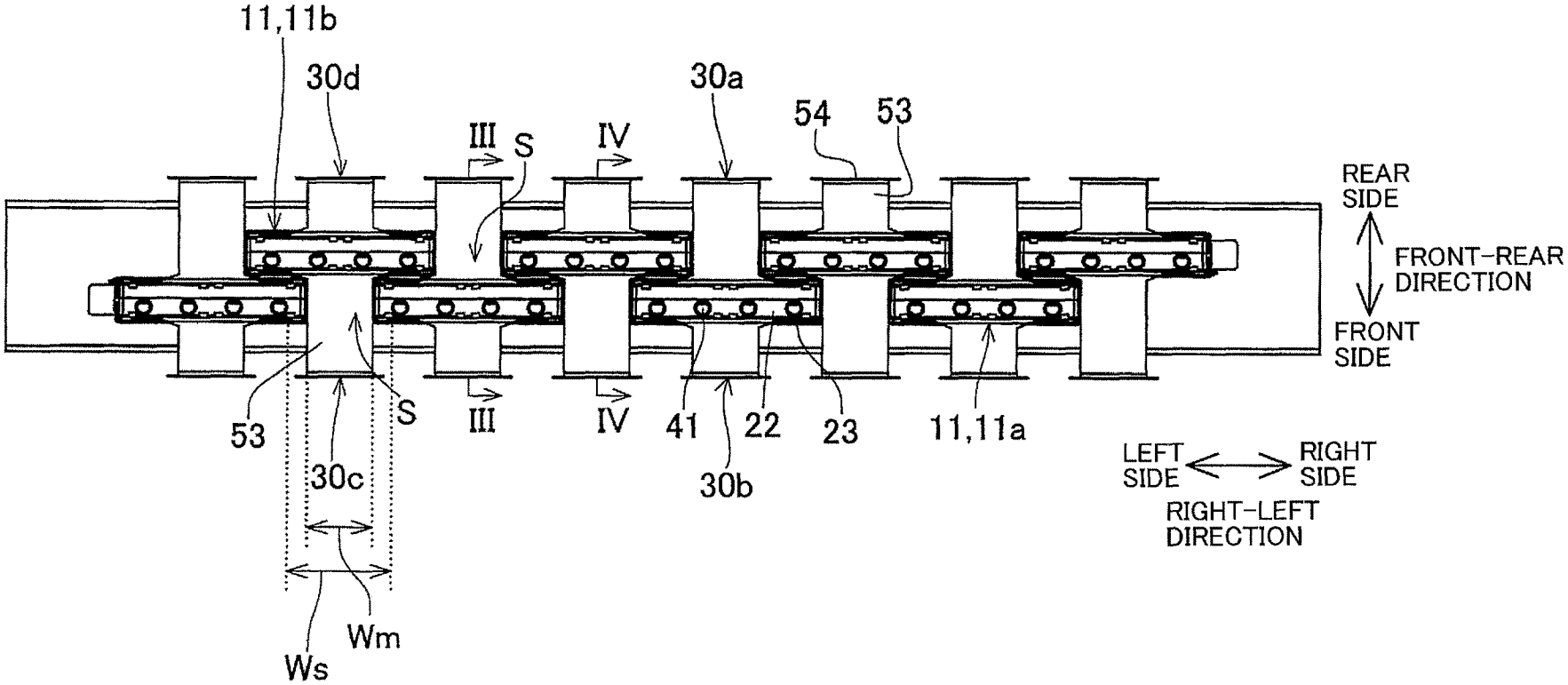
FIG. 2 is a plan view of head units 11, a holder 12, and wiring members 30*a*-30*d;*

The ink-jet head 2 is the so-called line head extending over an entire dimension of the recording sheet P in the right-left direction. As shown in FIGS. 1 and 2, the ink-jet head 2 includes a plurality of head units 11 and a holder 12. Each head unit 11 is elongate in the right-left direction and ejects ink from a plurality of nozzles 10 formed in its lower surface. Specifically, the nozzles 10 are arranged in the right-left direction (as one example of "first direction" and "predetermined direction") so as to form a nozzle row 9. In the head unit 11, four nozzle rows 9 are arranged in the front-rear direction. Black ink is ejected from the nozzles 10 of the rearmost nozzle row 9, yellow ink is ejected from the nozzles 10 of the second nozzle row 9 from the rear side, cyan ink is ejected from the nozzles 10 of the third nozzle row 9 from the rear side, and magenta ink is ejected from the nozzles 10 of the fourth nozzle row 9 from the rear side.

The plurality of head units 11 are arranged in the right-left direction (as one example of "first direction" and "predetermined direction") with a spacing S interposed between adjacent two of the head units 11, so as to form a head-unit row 8. The ink-jet head 2 includes two head-unit rows 8 arranged in the front-rear direction (as one example of "second direction"). The head units 11 a (each as one example of "second head unit") in a front-side head-unit row 8 are shifted toward the left side with respect to the head units 11*b* (each as one example of "first head unit") in a rear-side head-unit row 8. A left end portion of one head unit 11*a* and a right end portion of one head unit 11*b* overlap in the front-rear direction, and a right end portion of one head unit 11*a* and a left end portion of one head unit 11*b* overlap in the front-rear direction. In the following explanation, "A overlaps B in a direction" means that, when A and B are viewed in the direction, one of: at least a part of A; and at least a part of B is hidden by the other of: at least a part of A; and at least a part of B, or one of: at least a part of A; and at least a part of B and the other of: at least a part of A; and at least a part of B align with each other in the direction. In other words, when A and B are projected onto a plane orthogonal to the direction, at least a part of projective image of A and at least a part of projective image of B exist in the same region.

The holder 12 extends in the right-left direction and holds the plurality of head units 11 in the positional relationship described above.

The platen 3 is disposed below and opposed to the ink-jet head 2. The platen 3 has a dimension in the right-left direction larger than that of the recording sheet P and supports the recording sheet P from below.

The conveyance roller 4 is disposed on the rear side of the ink-jet head 2 and the platen 3. The conveyance roller 5 is disposed on the front side of the ink-jet head 2 and the platen 3. The conveyance rollers 4, 5 convey the recording sheet P toward the front side.

The printer 1 performs printing on the recording sheet P by ejecting ink from the nozzles 10 of the head units 11 while the recording sheet P is being conveyed toward the front side by the conveyance rollers 4, 5.

Head Unit

The head unit 11 will be explained. As shown in FIGS. 2-5, each head unit 11 includes a head chip 21, a supply unit 22, and a heat sink 23. The head chip 21 includes ink passages including the nozzles 10 and actuators for giving ejection energy to the ink in the ink passages.

The supply unit 22 is disposed on an upper surface of the head chip 21. There are formed, in the supply unit 22, supply passages (not shown) communicating with the ink passages in the head chip 21. An elastic member 27 formed of sponge or the like is attached to each of a front surface and a rear surface of the supply unit 22.

As shown in FIG. 2, four supply pipes 41 are provided at an upper end portion of the supply unit 22 (as one example of "one of opposite sides of the head chip that is remote from the nozzles in the third direction"). Each of the four supply pipes 41 has a cylindrical shape extending in the up-down direction (as one example of "third direction"). The four supply pipes 41 are disposed in an inside area located on an inner side of opposite ends of the head chip 21 in the right-left direction, so as to be spaced from each other in the right-left direction. With this configuration, the spacing S between the two of the head units 11*a* and between the two of the head units 11*b* has the largest width (Ws) in the right-left direction between the supply pipes 41 of the adjacent two head units 11.

Figure 3:
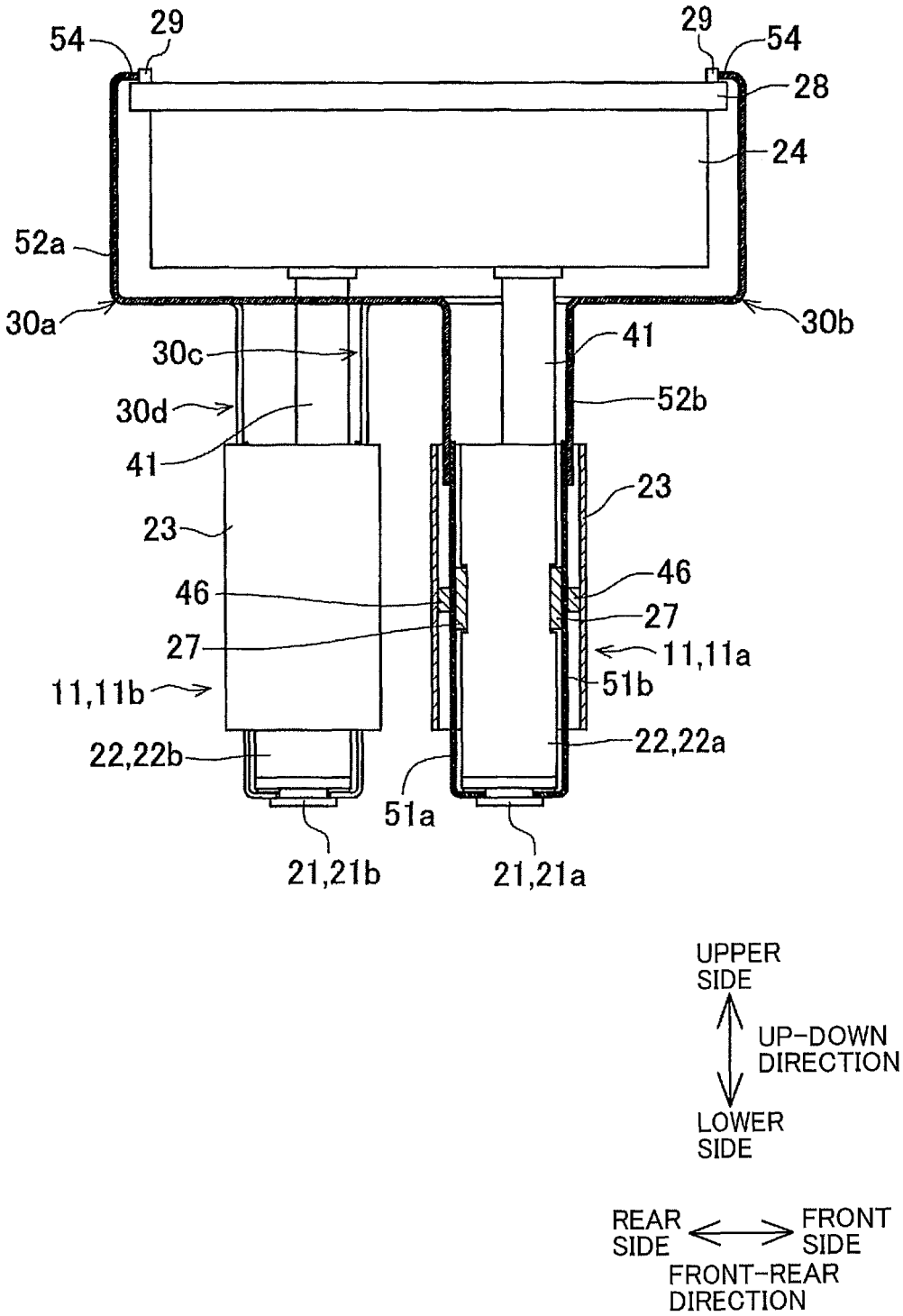
FIG. 3 is a cross-sectional view taken along III-III in FIG. 2.
Figure 4:
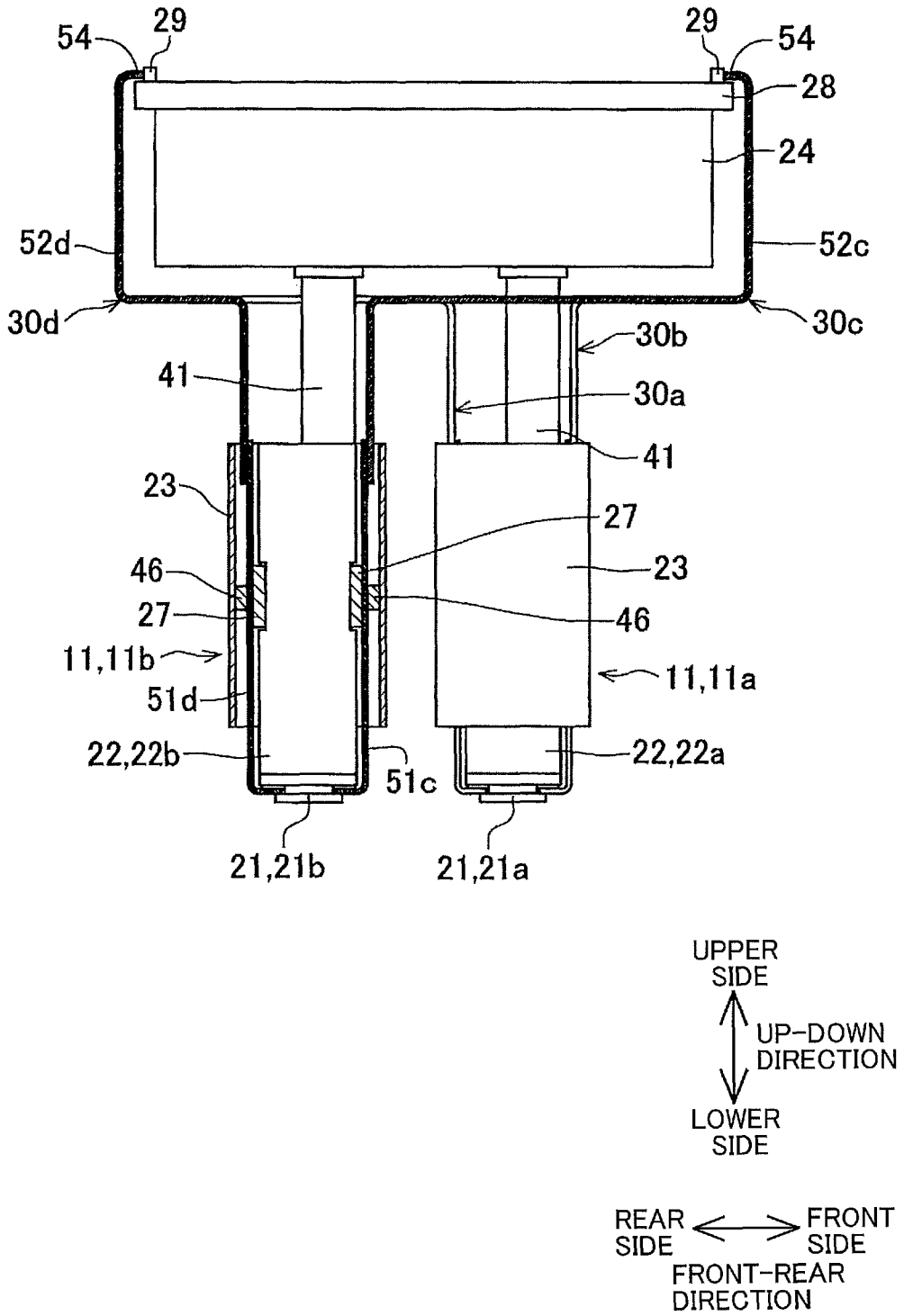
FIG. 4 is a cross-sectional view taken along line IV-IV in FIG. 2.

As shown in FIGS. 3 and 4, a sub tank 24 common to the plurality of head units 11 are disposed above the supply unit 22. The sub tank 24 includes four ink chambers not shown. The black ink, the yellow ink, the cyan ink, and the magenta ink supplied from respective ink cartridges (not shown) are stored in the respective four ink chambers. The four supply pipes 41 are respectively connected to the four ink chambers in the sub tank 24. The black ink, the yellow ink, the cyan ink, and the magenta ink are supplied respectively to the rightmost supply pipe 41, the second supply pipe 41 from the right, the third supply pipe 41 from the right, and the fourth supply pipe 41 from the right. The ink supplied from the supply pipes 41 flows into the ink passages in the head chip 21 via the supply passages in the supply unit 22.

The heat sink 23 is formed of metal and is disposed so as to surround the supply unit 22 in plan view. The heat sink 23 is for dissipating heat generated in driver ICs 46 to an exterior.

Wiring Member

There is disposed, over the sub tank 24, a board 28 extending in the right-left direction and the front-rear direction across the head units 11. The board 28 is for sending control signals to the driver ICs 46. A plurality of connectors 29 are provided at opposite end portions of the board 28 in the front-rear direction so as to be arranged in the right-left direction. The connectors 29 are provided for the individual head units 11.

The head chip 21 of each head unit 11*a* (hereinafter also referred to as "head chip 21*a*") is connected to the board 28 via a wiring member 30*a* (as one example of "first wiring member") and a wiring member 30*b* (as one example of "second wiring member"). The wiring member 30*a* is a board having flexibility and is constituted by a chip on film (COF) board 51*a* (as one example of "first board") and a flexible printed circuit (FPC) board 52*a* (as one example of "second board").

Figure 5:
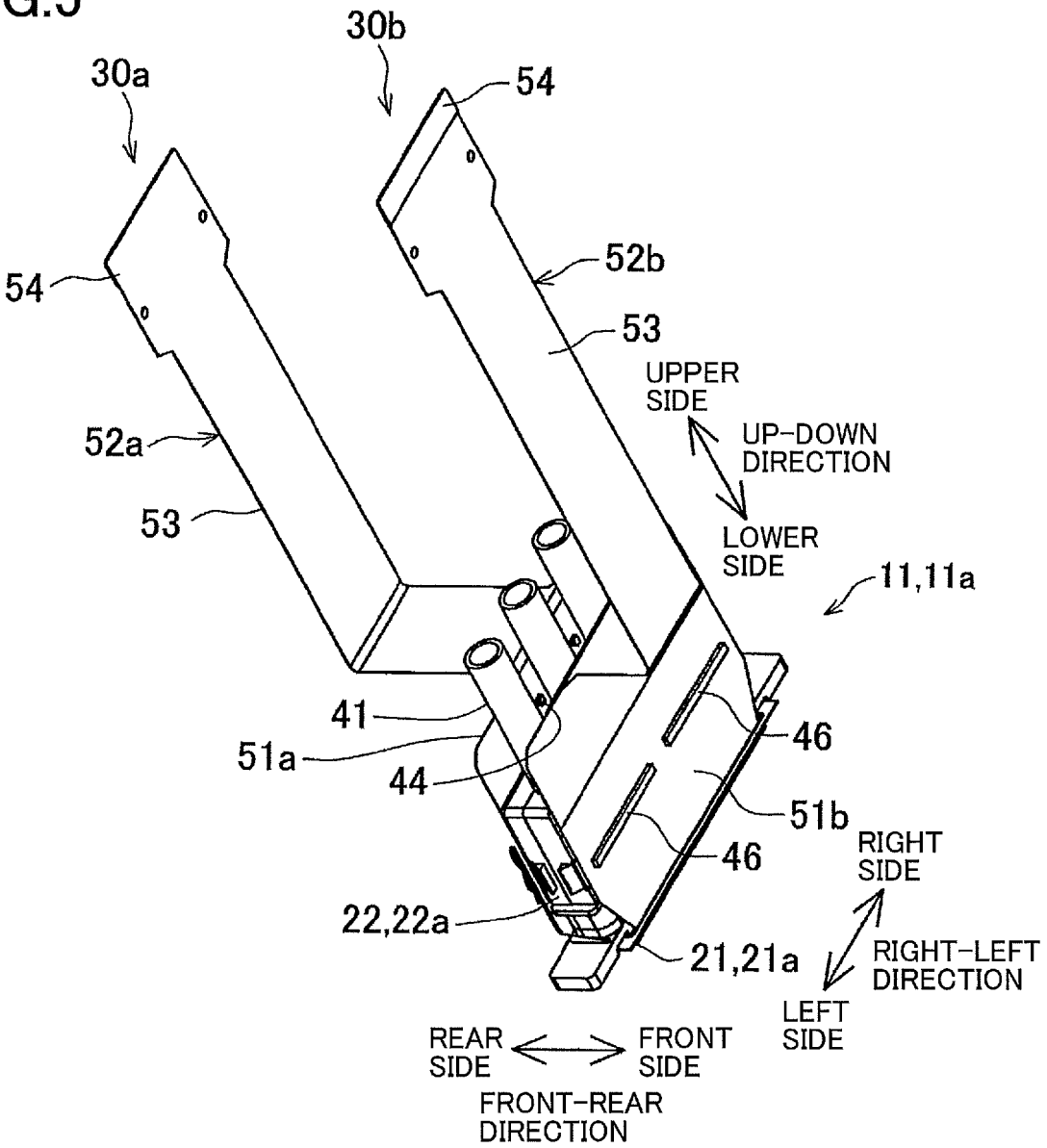
FIG. 5 is a perspective view of one head unit 11*a* from which a heat sink 23 is removed and two wiring members 30*a*, 30*b* connected to the head unit 11*a:*
Figure 6:
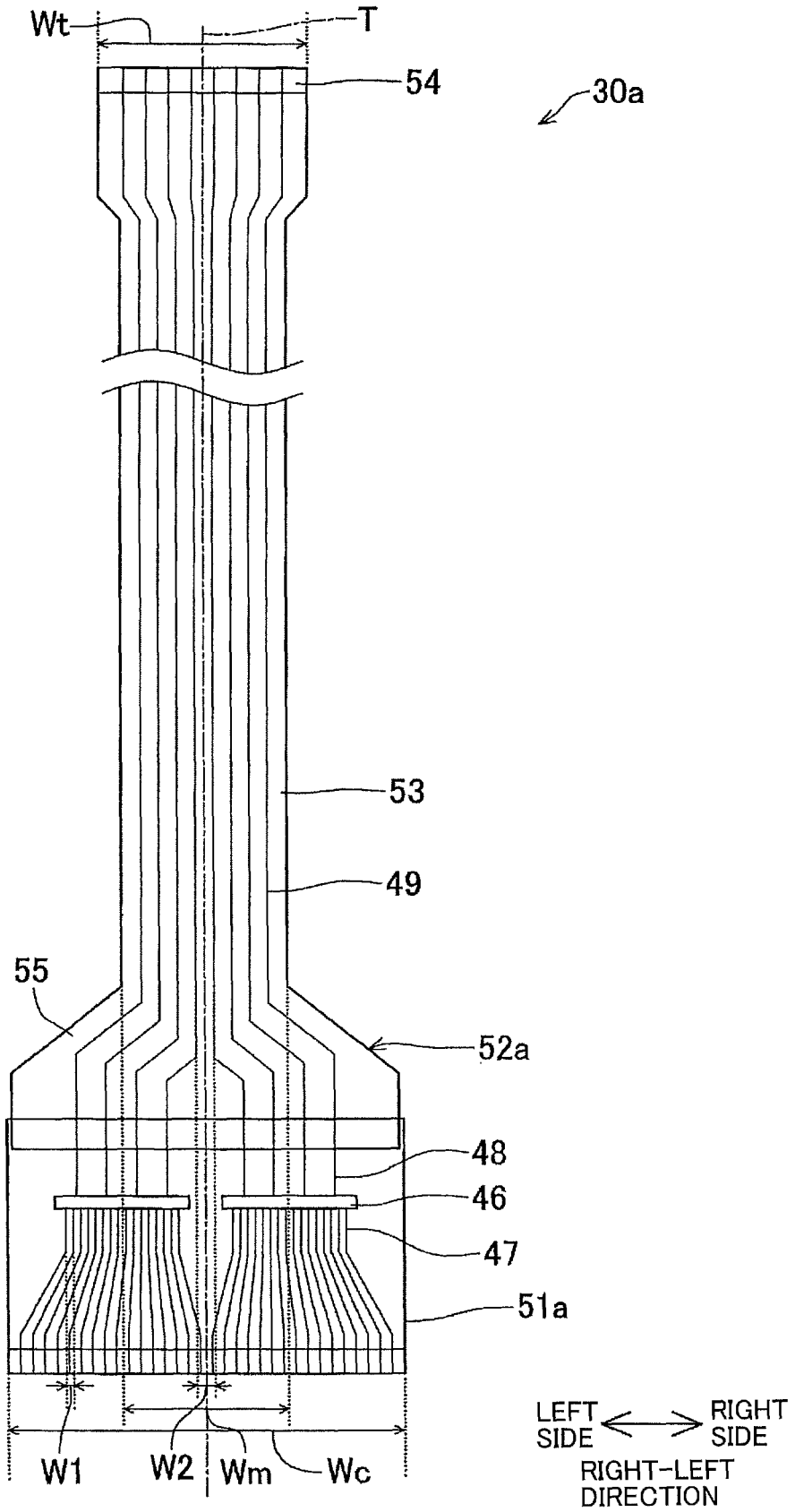
FIG. 6 is a plan view of the wiring member 30*a* in its extended state.

As shown in FIG. 6, the COF board 51*a* has a width We in the right-left direction larger than a maximum width Ws of the spacing S. As shown in FIGS. 3 and 5, the COF board 51*a* is drawn from a connected position, at which the COF board 51 is connected to the head chip 21*a*, toward the rear side, immediately bent upward, and extends in the up-down direction between the rear surface of the supply unit 22 of the head unit 11*a* (hereinafter also referred to as "supply unit 22*a*") and the heat sink 23. An upper end of the COF board 51*a* is located at a position lower than each supply pipe 41 of the supply unit 22, namely, located on one of opposite sides of each supply pipe 41 nearer to the head chip 21*a* in the third direction.

Two driver ICs 46 (each as one example of "drive circuit") arranged in the right-left direction are mounted on the COF board 51*a* at its portion between the rear surface of the supply unit 22*a* and the heat sink 23, which portion is located at the same height level as the elastic members 27. Each driver IC 46 is elongate in the right-left direction and is pressed onto the heat sink 23 by the elastic member 27. Thus, the driver ICs 46 are held in close contact with the heat sink 23, and heat generated in the driver ICs 46 is efficiently dissipated to the exterior via the heat sink 23.

The COF board 51*a* includes a plurality of individual wires 47 and a plurality of control wires 48. The individual wires 47 respectively correspond to the nozzles 10 and connect the two driver ICs 46 and the head chip 21*a* to each other. Specifically, the individual wires 47 disposed at a left half portion of the COF board 51*a* correspond to the nozzles 10 of a left half portion of the head unit 11 and are connected to the left-side driver IC 46. The individual wires 47 disposed at a right half portion of the COF board 51*a* correspond to the nozzles 10 of a right half portion of the head unit 11 and are connected to the right-side driver IC 46. The individual wires 47 disposed at the left half portion and the individual wires 47 disposed at the right half portion are symmetrical in the right-left direction with respect to a line T which passes a center of the COF board 51*a* in the right-left direction and which is orthogonal to the right-left direction. The number of the control wires 48 is smaller than that of the individual wires 47. The control wires 48 are connected to the driver ICs 46 and extend from the driver ICs 46 opposite to the head chip 21*a*, namely, in a direction away from the head chip 21*a*. The control wires 48 are also disposed so as to be symmetrical in the right-left direction with respect to the line T. In other words, the individual wires 47 and the control wires 48 are disposed so as to be symmetrical in the right-left direction with respect to a plane which is orthogonal to the right-left direction and on which the center of the COF board 51*a* in the right-left direction exists.

The FPC board 52*a* is a wiring board having flexibility and is connected to the upper end of the COF board 51*a*. The COF board 51*a* and the FPC board 52*a* are connected to each other such that the center of the COF board 51*a* in the right-left direction and the center of the FPC board 52*a* in the right-left direction coincide with each other. The FPC board 52*a* includes a plurality of control wires 49. The control wires 49 are connected to the control wires 48 and extend in an extension direction of the FPC board 52*a*. The control wires 49 are also disposed so as to be symmetrical in the right-left direction with respect to the line T. In other words, the control wires 49 are disposed so as to be symmetrical in the right-left direction with respect to a plane which is orthogonal to the right-left direction and on which the center of the FPC board 52*a* exists.

The FPC board 52*a* has a width in the right-left direction substantially equal to the width We of the COF board 51*a* at and near its portion at which the FPC board 52*a* is connected to the COF board 51*a*, namely, at and near a connection of the FPC board 52*a* and the COF board 51*a*. In the present embodiment, a large-width portion is constituted by a combination of: a portion of the wiring member 30*a* formed by the COF board 51*a*; and the portion of the FPC board 52*a* having the width in the right-left direction substantially equal to the width We of the COF board 51*a*.

The FPC board 52*a* extends upward from the connection of the FPC board 52*a* and the COF board 51*a* and is opposed to the four supply pipes 41 in the front-rear direction. Circuit elements 44 are disposed at a portion of the FPC board 52*a* located at the same height level as the four supply pipes 41, such that each circuit element 44 is located between adjacent two of the supply pipes 41 in the right-left direction. The circuit elements 44 are resistors, capacitors or the like each for noise reduction, for instance, and are connected to the control wires 49.

The FPC board 52*a* includes a tapered portion 55 at its upper portion having a width in the right-left direction which gradually reduces in a direction away from the COF board 51*a*. The FPC board 52*a* includes a small-width portion 53 which is located further from the COF board 51*a* than the tapered portion 55. The small-width portion 53 has a width Wm in the right-left direction smaller than the maximum width Ws of the spacing S. The FPC board 52*a* is bent rearward at the small-width portion 53, and the small-width portion 53 passes between the supply pipes 41 of adjacent two of the head units 11*b* in the spacing S (as one example of "space existing next to the first head unit in the first direction") between the adjacent two of the head units 11*b*. Thus, the FPC board 52*a* extends rearward beyond the head units 11*b* so as to avoid the head units 11*b*.

Further, the FPC board 52*a* is bent upward on the rear side of the head unit 11*b*. A connecting portion 54, which is an end of the FPC board 52*a* opposite to another end thereof located nearer to the head chip 21*a*, is connected to the connector 29 provided on a rear-side end portion of the board 28. As shown in FIG. 6, the connecting portion 54 has a width Wt in the right-left direction larger than the width Wm of the small-width portion 53.

The wiring member 30*b* is identical in structure with the wiring member 30*a* and is constituted by a COF board 51*b* and an FPC board 52*b* which are identical in structure with the COF board 51*a* and the FPC board 52*a*, respectively. The COF board 51*b* is drawn from a connected position, at which the COF board 51*b* is connected to the head chip 21*a*, toward the front side, immediately bent upward, and extends in the up-down direction between a front surface of the supply unit 22*a* and the heat sink 23. The driver ICs 46 are pressed onto the heat sink 23 by the elastic members 27. The FPC board 52*b* extends upward from a connection at which the FPC board 52*b* is connected to the COF board 51*b* and is bent toward the front side. Further, the FPC board 52*b* is bent and extends upward, and the connecting portion 54 is connected to the connector 29 provided on a front-side end portion of the board 28.

The head chip 21 of the head unit 11*b* (hereinafter referred to as "head chip 21*b*") is connected to the board 28 via two wiring members 30*c*, 30*d*. The wiring member 30*c* (as one example of "third wiring member") is identical in structure with the wiring members 30*a*, 30*b* and is constituted by a COF board 51*c* which is identical in structure with the COF boards 51*a*, 51*b* and an FPC board 52*c* which is identical in structure with the FPC boards 52*a*, 52*b*. The COF board 51*c* is drawn from a connected position, at which the COF board 51*c* is connected to the head chip 21*b*, toward the front side, immediately bent upward, and extends in the up-down direction between a front surface of the supply unit 22 of the head unit 11*b* (hereinafter referred to as "supply unit 22*b*") and the heat sink 23. The driver ICs 46 are pressed onto the heat sink 23 by the elastic members 27. The FPC board 52*c* extends upward from a connection, at which the FPC board 52*c* is connected to the COF board 51*c*, is bent toward the front side, and the small-width portion 53 passes between the supply pipes 41 of adjacent two of the head units 11*a* in the spacing S therebetween. Thus, the FPC board 52*c* extends frontward beyond the head units 11*a* so as to avoid the head units 11*a*. Further, the FPC board 52*c* is bend and extends upward, and the connecting portion 54 is connected to the connector 29 provided on the front-side end portion of the board 28.

The wiring member 30*d* is identical in structure with the wiring members 30*a*-30*c* and is constituted by a COF board 51*d* which is identical in structure with the COF boards 51*a*-51*c* and an FPC board 52*d* which is identical in structure with the FPC boards 52*a*-52*c*. The COF board 51*d* is drawn from a connected position, at which the COF board 52*d* is connected to the head chip 21*b*, toward the rear side, immediately bent upward, and extends in the up-down direction between a rear surface of the supply unit 22*b* and the heat sink 23. The driver ICs 46 are pressed onto the heat sink 23 by the elastic members 27. The FPC board 52*d* extends upward from a connection, at which the FPC board 52*d* is connected to the COF board 51*d*, and is bent toward the rear side. Further, the FPC board 52*d* is bent and extends upward, and the connecting portion 54 is connected to the connector 29 provided on the rear-side end portion of the board 28.

When printing data is input to the printer 1, signals in accordance with the printing data are transmitted from the board 28 to the driver ICs 46 of the wiring members 30*a*-30*d* via the control wires 48, 49. The driver ICs 46 transmit signals for driving the corresponding head units 11 via the corresponding individual wires 47 in accordance with the received signals. Thus, the ink is ejected from the nozzles 10 in accordance with the printing data.

In the embodiment described above, the driver ICs 46 are provided on the wiring members 30*a*-30*d* which are disposed outside the head unit 11, so that the head unit 11 is downsized as compared with an arrangement in which the driver ICs 46 are incorporated in the head unit 11 (such as the head chip 21). In this case, however, each of the wiring members 30*a*-30*d* requires a space for mounting the driver ICs 46. Further, it is required for the wiring members 30*a* except the leftmost wiring member 30*a* to pass through the spacing S between corresponding adjacent two head units 11*b* for permitting the wiring members 30*a* to extend rearward beyond the head units 11*b*. Similarly, it is required for the wiring members 30*c* to pass through the spacing S between corresponding adjacent two head units 11*a* for permitting the wiring members 30*c* to extend frontward beyond the head units 11*a*.

In the present embodiment, therefore, the wiring member 30*a* is constituted by: the COF board 51*a* whose width We in the right-left direction is larger than the maximum width Ws of the spacing S; and the FPC board 52*a* having the small-width portion 53 whose width Wm in the right-left direction is smaller than the maximum width Ws of the spacing S. Thus, the wiring member 30*a* has a space enough for mounting the driver ICs 46. Further, this arrangement enables the wiring member 30*a* to pass through the spacing S and extend rearward beyond the head units 11*b*.

Similarly, the wiring member 30*c* is constituted by the COF board 51*c* and the FPC board 52*c*, whereby the wiring member 30*c* passes through the spacing S and extends frontward beyond the head units 11*a* while the wiring member 30*c* has a space enough for mounting the driver ICs. The wiring members 30*b*, 30*d* respectively include the COF board 51*b* and the COF board 51*d*, whereby each of the wiring members 30*b*, 30*d* has an enough space for mounting the driver ICs 46.

In the present embodiment, the width in the right-left direction of the spacing S between adjacent two of the head units 11*b* is the maximum width Ws at a portion of the spacing S between the supply pipes 41 of the adjacent two head units 11*b*. In the present embodiment, the small-width portion 53 of the FPC board 52*a* passes through the spacing S between the supply pipes 41 of the adjacent two head units 11*b* and extends rearward beyond the head units 11*b*. This arrangement makes it possible to maximize the width Wm of the small-width portion 53 in the right-left direction. Consequently, a pitch W2 of the control wires 49 of the small-width portion 53 is maximized so as to prevent a short circuit among the control wires 49. The same applies to the wiring member 30*c*. In the present embodiment, as shown in FIG. 2, the width Wm of the small-width portion 53 in the right-left direction is substantially equal to a width of the spacing S at its portion between the outermost ends of the adjacent two head units 11*b*. In a case where the number of the control wires 49 is relatively large, however, the width Wm of the small-width portion 53 of the wiring member 30*a* may be increased within a range smaller than the width Ws, thereby enabling the small-width portion 53 to pass between the adjacent two head units 11*b* and to extend in the front-rear direction. The same applies to the wiring member 30*c*.

In the present embodiment, the wiring member 30*a* is constituted by the COF board 51*a* and the FPC board 52*a*. It is noted here that a pitch W1 of the individual wires 47 provided on the COF board 51*a* is smaller than the pitch W2 of the control wires 49 provided on the FPC board 52*a*. In general, a production cost for unit length of wiring boards such as the COF board and the FPC board increases with a decrease in a minimum pitch of the wires provided on the wiring boards. Unlike the present embodiment, if the wiring member 30*a* is constituted by a single wiring board having a portion corresponding to the COF board 51*a* and a portion corresponding to the FPC board 52*a*, it is inevitably required to form a COF board with a large length including the portion corresponding to the FPC board 52*a* in which the pitch of the wires is large. This undesirably pushes up the production cost of the wiring member 30*a*. The same applies to the wiring members 30*b*-30*d*.

When the COF board 51*a* of the wiring member 30*a* is bonded to the head chip 21, a relatively expensive adhesive such an anisotropic conductive film (ACF) or a nonconductive film (NCF) is used for connecting, to the wires on the head chip 21, the individual wires 47 formed on the COF board 51*a* at a small pitch. In contrast, the pitch of the control wires 48 and the pitch of the control wires 49 are larger than the pitch of the individual wires 47. Consequently, it is not necessary to use such an expensive adhesive to bond the COF board 51*a* and the FPC board 52*a* to each other. For instance, the COF board 51*a* and the FPC board 52*a* are bonded to each other by relatively inexpensive soldering. The same applies to the wiring members 30*b*-30*d*.

In the present embodiment, the wiring member 30*a* is constituted by the COF board 51*a* and the FPC board 52*a*, whereby it is possible to decrease the production cost of the wiring member 30*a*, as compared with an arrangement in which the wiring member 30*a* is constituted by a single wiring member. The same applies to the wiring members 30*b*-30*d*.

In the present embodiment, the wiring member 30*a* is constituted by the COF board 51*a* and FPC board 52*a* which are connected such that the center of the COF board 51*a* in the right-left direction and the center of the FPC board 52*a* in the right-left direction coincide with each other. This configuration maximizes the width in the right-left direction of a portion of the FPC board 52*a*, which portion is located at the same position in the right-left direction as the COF board 51*a*. The same applies to the wiring members 30*b*-30*d*.

In the present embodiment, the connection of the FPC board 52*a* and the COF board 51*a* of the wiring member 30*a* extends in the up-down direction. The FPC board 52*a* is bent rearward at the small-width portion 53. Similarly, the FPC board 52*c* of the wiring member 30*c* is bent frontward at the small-width portion 53.

Here, a case different from the present embodiment is considered. That is, the wiring member 30*a* is bent rearward at its portion located nearer to the head chip 21*a* than the small-width portion 53 and having a larger width in the right-left direction, namely, at a portion having the same width in the right-left direction as the width We of the COF board 51*a* or at the tapered portion 55. In this case, both of the portion of the wiring member 30*a* having a larger width in the right-left direction than the small-width portion 53 and the small-width portion 53 partly extend in the front-rear direction between the head unit 11*a* and the head units 11*b* in the front-rear direction. Consequently, it is needed to increase a distance in the front-rear direction between the head unit 11*a* and the head units 11*b*.

Likewise, another case different from the present embodiment is considered. That is, the wiring member 30*c* is bent frontward at its portion located nearer to the head chip 21*b* than the small-width portion 53 and having a larger width in the right-left direction. Also in this case, both of the portion of the wiring member 30*c* having a larger width in the right-left direction than the small-width portion 53 and the small-width portion 53 partly extend in the front-rear direction between the head units 11*a* and the head unit 11*b*. Consequently, it is needed to increase a distance in the front-rear direction between the head units 11*a* and the head unit 11*b*.

In the present embodiment, in contrast, the wiring member 30*a* is bent rearward at the small-width portion 53. In this configuration, only a part of the small-width portion 53 of the wiring member 30*a* extends in the front-rear direction between the head units 11*a* and the head unit 11*b* in the front-rear direction. Likewise, in the present embodiment, the wiring member 30*c* is bent frontward at the small-width portion 53. In this configuration, only a part of the small-width portion 53 of the wiring member 30*c* extends in the front-rear direction between the head units 11*a* and the head unit 11*b* in the front-rear direction. Consequently, it is possible to decrease a distance between the head units 11*a* and the head unit 11*b* in the front-rear direction, because the portion having a larger width in the right-left direction than the small-width portion 53 in the front-rear direction does not extend between the head units 11*a* and the head unit 11*b* in the front-rear direction.

It is noted here that, with a decrease in the distance between each head unit 11*a* and each head unit 11*b* in the front-rear direction, a shift amount in the right-left direction of the nozzles 10 of the head unit 11*a* and the nozzles 10 of the head unit 11*b* relative to each other decreases when the ink-jet head 2 inclines on a horizontal plane. Thus, the decrease in the distance between the head unit 11*a* and the head unit 11*b* in the front-rear direction makes it possible to minimize deterioration in a printed image when the ink-jet head 2 inclines on the horizontal plane.

Further, by bending each of the wiring members 30*a*, 30*d* upward at its portion located on the rear side of the head unit 11*b*, the connecting portion 54 of each wiring member 30*a*, 30*d* can be connected to the connector 29 of the board 28 disposed at an upper portion of the ink-jet head 2. Likewise, by bending each of the wiring members 30*b*, 30*c* upward at its portion located on the front side of the head unit 11*b*, the connecting portion 54 of each wiring member 30*b*, 30*c* can be connected to the connector 29 of the board 28 disposed at the upper portion of the ink-jet head 2.

In the present embodiment, the connection of the COF board 51*a* and the FPC board 52*a* of the wiring member 30*a* is located at a height level lower than the supply pipe 41. The control wires 48, 49 of the wiring member 30*a* are exposed at the connection. Should the ink leaks from the supply pipe 41, the leaked ink may undesirably reaches the connection if the connection is located at the same height level as the supply pipe 41, unlike the present embodiment. This may cause a risk of a short circuit in the control wires 48, 49. In the present embodiment, in contrast, the connection of the COF board 51*a* and the FPC board 52*a* is located at a lower height level than the supply pipe 41 and is distant from the supply pipe 41. Thus, even if the ink should leak from the supply pipe 41, the leaked ink is unlikely to reach the connection, thereby preventing a short circuit in the control wires 48, 49. The same applies to the wiring members 30*b*-30*d*.

In the present embodiment, the wiring members 30*a*-30*d* are identical in structure, thereby reducing the number of kinds of required components of the ink-jet head 2.

In the present embodiment, the two wiring members 30*a*, 30*b* are connected to the head chip 21*a* so as to be drawn therefrom respectively toward opposite sides of the head chip 21*a* in the front-rear direction. This configuration enables the wiring members to be drawn toward the opposite sides of the head chip 21*a* in the front-rear direction. Further, the wiring member 30*a* and the wiring member 30*b* are located at substantially the same position in the right-left direction. Likewise, the two wiring members 30*c*, 30*d* are connected to the head chip 21*b* so as to be drawn therefrom respectively toward opposite sides of the head chip 21*b* in the front-rear direction. This configuration enables the wiring members to be drawn toward the opposite sides of the head chip 21*b* in the front-rear direction. Further, the wiring member 30*c* and the wiring member 30*d* are located at substantially the same position in the right-left direction.

In the present embodiment, the connectors 29 are provided at opposite end portions of the board 28 in the front-rear direction so as to be arranged in the right-left direction. The connecting portions 54 of the wiring members 30*a*, 30*d* are connected to the connectors 29 provided at the rear-side end portion of the board 28 while the connecting portions 54 of the wiring members 30*b*, 30*c* are connected to the connectors 29 of the front-side end portions of the board 28. This configuration is easy to provide a space for mounting the connectors 29 on the board 28, as compared with a configuration in which the connectors 29 are arranged in one row at a central portion of the board 28 in the front-rear direction.

Where the wiring members 30*a*-30*d* are identical in structure as in the present embodiment, namely, where the wiring members 30*a*-30*d* are constituted by wiring members having mutually the same structure, the wiring members 30*b*, 30*c* drawn frontward from the head units 11*a*, 11*b* are disposed in a posture inverted with respect to the wiring members 30*a*, 30*d* drawn rearward from the head units 11*a*, 11*b*. In the present embodiment, the wires 47-49 formed on the COF boards 51*a*-51*d* and the FPC boards 52*a*-52*d* of the wiring members 30*a*-30*d* are disposed so as to be symmetrical in the right-left direction with respect to the line T, in other words, with respect to the plane which is orthogonal to the right-left direction and on which the center of the COF boards 51*a*-51*d* and the center of the FPC boards 52*a*-52*d* exist. With this configuration, the wiring member 30*a* and the wiring member 30*b* do not shift relative to each other in the right-left direction, and the wiring member 30*b* and the wiring member 30*d* do not shift relative to each other in the right-left direction. Consequently, it is easy to design the board 28 on which the connectors 29 need to be disposed in accordance with the layout of the wiring members 30*a*-30*d*.

In the present embodiment, the width Wt in the right-left direction of the connecting portion 54 to be connected with the connector 29 of the board 28 is larger than the width Wm in the right-left direction of the small-width portion 53. This enables easy connection of the connecting portion 54 to the connector 29.

In the present embodiment, the circuit elements 44 such as resistors and capacitors, each for noise reduction, are disposed at the portion of each FPC board 52*a*-52*d* located at the same height level as the supply pipes 41, such that each circuit element 44 is located between adjacent two supply pipes 41 in the right-left direction. In other words, the supply pipe 41 and the circuit element 44 are disposed so as to be shifted relative to each other in the right-left direction, thereby preventing interference between the circuit element 44 and the supply pipe 41.

There will be explained modifications.

In the illustrated embodiment, the spacing S between the adjacent two head units 11*b* has the largest width in the right-left direction between the supply pipes 41 of the adjacent two head units 11*b*, and the small-width portion 53 of the FPC board 52*a* passes between the supply pipes 41 of the adjacent two head units 11*b* and extend in the front-rear direction. This is not necessarily required.

The spacing S between the adjacent two head units 11*b* may have the largest width in the right-left direction at a portion of the spacing S different from the above-indicated portion between the supply pipes 41 of the adjacent two head units 11*b*, and the small-width portion 53 of the FPC board 52*a* may pass a portion of the spacing S between the adjacent two head units 11*b* in the right-left direction, which portion has the largest width in the front-rear direction. For instance, each head unit 11*b* may have a constricted portion curved inwardly in the right-left direction, and the width dimension of the head unit 11*b* in the right-left direction is the smallest at the constricted portion. In this case, the small-width portion 53 of the wiring member 30*a* may pass a space between the constricted portions of the adjacent two head units 11*b*, so as to extend in the front-rear direction. Alternatively, the FPC board 52*a* may pass a portion different from the portion of the spacing S between the adjacent two head units 11*b* having the largest width in the right-left direction, so as to extend in the front-rear direction. The same applies to the spacing S between the adjacent two head units 11*a* and to the FPC board 52*c*.

In the illustrated embodiment, the width Wt in the right-left direction of the connecting portion 54 of the wiring member 30*a*-30*d* is larger than the width Wm in the right-left direction of the small-width portion 53. This is not necessarily required. For instance, the width Wt in the right-left direction of the connecting portion 54 may be equal to or smaller than the width Wm in the right-left direction of the small-width portion 53.

In the illustrated embodiment, the wires 47-49 of the wiring member 30*a*-30*d* are disposed so as to be symmetrical in the right-left direction with respect to the line which passes the center of the wiring member 30*a*-30*d* in the right-left direction and which is orthogonal to the right-left direction, namely, with respect to the plane which is orthogonal to the right-left direction and on which the center of the wiring member 30*a*-30*d* exists. This is not necessarily required. The wires 47-49 may be disposed otherwise in the wiring member 30*a*-30*d*.

In the illustrated embodiment, in the wiring member 30*a*, the center of the COF board 51*a* in the right-left direction and the center of the FPC board 52*a* in the right-left direction coincide with each other. This is not necessarily required. The center of the COF board 51*a* and the center of the FPC board 52*a* may be shifted relative to each other in the right-left direction. The same applies to the wiring members 30*b*-30*d*.

In the illustrated embodiment, the wiring members 30*a*-30*d* have the mutually the same structure. This is not necessarily required. Among the two wiring members connected to the head unit 11*a* and the two wiring members connected to the head unit 11*b*, at least a part of those may have a structure different from other wiring members.

Figure 7:
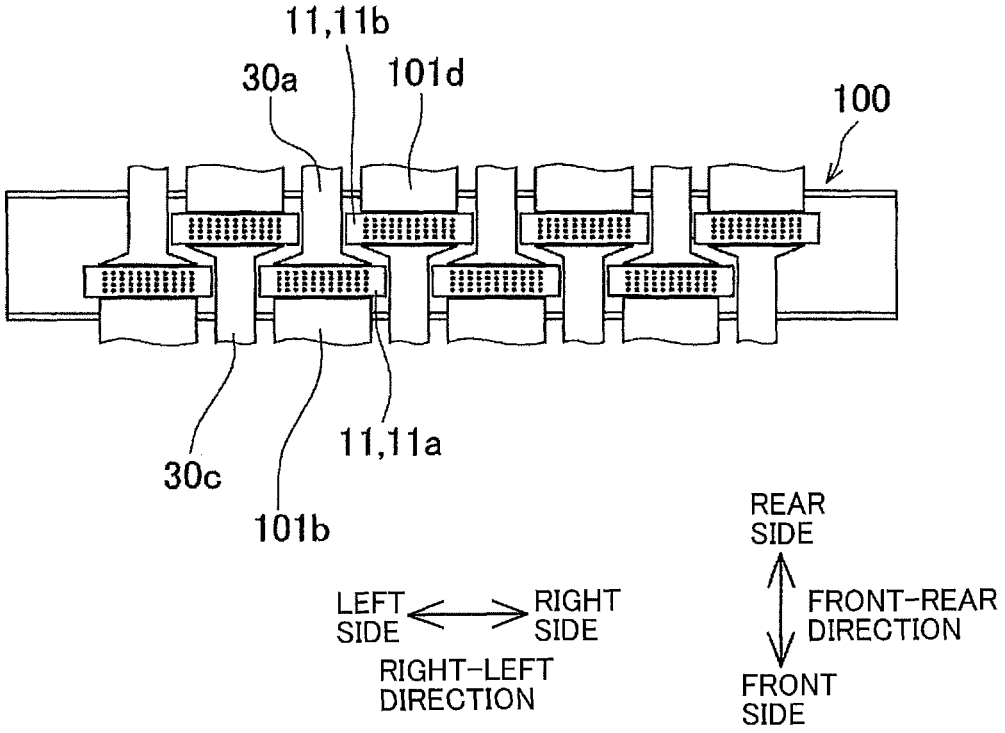
FIG. 7 is a schematic view of an ink-jet head 2 according to a first modification.

In an ink-jet head 100 according to a first modification shown in FIG. 7, the wiring members 30*b*, 30*d* of the ink-jet head 2 are replaced with wiring members 101*b*, 101*d*. Each of the wiring members 101*b*, 101*d* has a constant width in the right-left direction which is substantially the same as the width Wc (FIG. 6) of each COF board 51*b*, 51*d* in the illustrated embodiment. The wiring members 101*b*, 101*d* are formed, for instance, by replacing the FPC boards 52*b*, 52*d* with FPC boards having a width in the right-left direction that is substantially equal to the width Wc of the COF board 51*b*, 51*d*.

In the illustrated embodiment, the wiring members 30*a*, 30*c* need to have the small-width portions 53 because the wiring members 30*a*, 30*c* pass through the spacing S. In contrast, because the wiring members 30*b*, 30*d* have no portions that pass through the spacing S, the wiring members 30*b*, 30*d* need not necessarily have the small-width portion. In view of this, the wiring members 101*b*, 101*d* in the first modification have a larger width in the right-left direction without having the small-with portions 53*d*, as compared with the wiring members 30*b*, 30*d*. This configuration ensures a higher degree of freedom in the layout of the wiring members 101*b*, 101*d*.

In the illustrated embodiment, the connection of the COF board 51*a* and the FPC board 52*a* of the wiring member 30*a* is located at the height level lower than the supply pipes 41. This is not necessarily required. The connection may be located at the same height level as the supply pipes 41. In general, there is no risk of leakage of the ink from the supply pipes 41. Thus, unless the ink leakage occurs, there is no risk of a short circuit of the wires due to ink leakage even when the connection is located at the same height level as the supply pipes 41. The same applies to the wiring members 30*b*-30*d*.

In the illustrated embodiment, the wiring member 30*a* is bent rearward at the small-width portion 53, and the wiring member 30*c* is bent frontward at the small-width portion 53. This is not necessarily required. The wiring member 30*a* may be bent rearward at its portion located nearer to the head chip 21*a* than the small-width portion 53 and having a larger width in the right-left direction. Likewise, the wiring member 30*c* may be bent frontward at its portion located nearer to the head chip 21*b* than the small-width portion 53 and having a larger width in the right-left direction.

In the illustrated embodiment, the wiring member 30*a* is constituted by the COF board 51*a* and the FPC board 52*a*. This is not necessarily required. For instance, the wiring member 30*a* may be constituted by two COF boards. The same applies to the wiring members 30*b*-30*d* and the wiring members 101*a*-101*d* of the first modification.

Alternatively, the wiring member 30*a* may be constituted by a single board having flexibility which integrally includes a portion corresponding to the COF board 51*a* (i.e., a portion including the large-width portion on which the driver ICs 46 are mounted) and a portion corresponding to the FPC board 52*a* (i.e., a portion including the small-width portion which passes through the spacing S between the adjacent two head units 11*b*). This configuration eliminates a step of bonding the two boards in the manufacturing process of the wiring member 30*a*, thereby reducing the number of steps in the manufacturing process of the wiring member 30*a*. The same applies to the wiring members 30*b*-30*d* and the wiring members 101*a*-101*d* of the first modification.

In the illustrated embodiment, the two driver ICs 46 arranged in the right-left direction are mounted on the COF board 51*a*. This is not necessarily required. One driver IC 46 or at least three drivers IC 46 arranged in the right-left direction may be mounted on the COF board 51*a*. Further, the driver ICs 46 need not be necessarily arranged in the right-left direction when a plurality of driver ICs 46 are mounted on the COF board 51*a*. For instance, the driver ICs 46 may be arranged in the extension direction of the COF board 51*a*. The same applies to the driver ICs 46 mounted on the COF boards 51*b*-51*d*. Moreover, the driver IC need not to be elongate in the right-left direction, i.e., the arrangement direction of the nozzles 10.

In the illustrated embodiment, the connectors 29 are provided at one and the other of opposite end portions of the board 28 in the front-rear direction, so as to be arranged in the right-left direction. This is not necessarily required. The connectors 29 may be provided at a portion of the board 28 different from that in the illustrated embodiment. For instance, the connectors 29 may be arranged in the right-left direction in one row at a central portion of the board 28 in the front-rear direction.

In the illustrated embodiment, each circuit element 44 of the FPC board 52*a*-52*d* and each supply pipe 41 are disposed so as to be shifted relative to each other in the right-left direction. This is not necessarily required. For example, the circuit element 44 of the FPC board 52*a*-52*d* and the supply pipe 41 may be located at the same position in the right-left direction in an instance where the FPC board 52*a*-52*d* and the supply pipe 41 are sufficiently distant from each other in the front-rear direction.

In the illustrated embodiment, the wiring member 30*a*-30*d* extends from the head chip 21 to the board 28 so as to be bent at respective bent portions. For easy bending, a notch may be formed at each of the bent portions of the wiring member.

Figure 8:
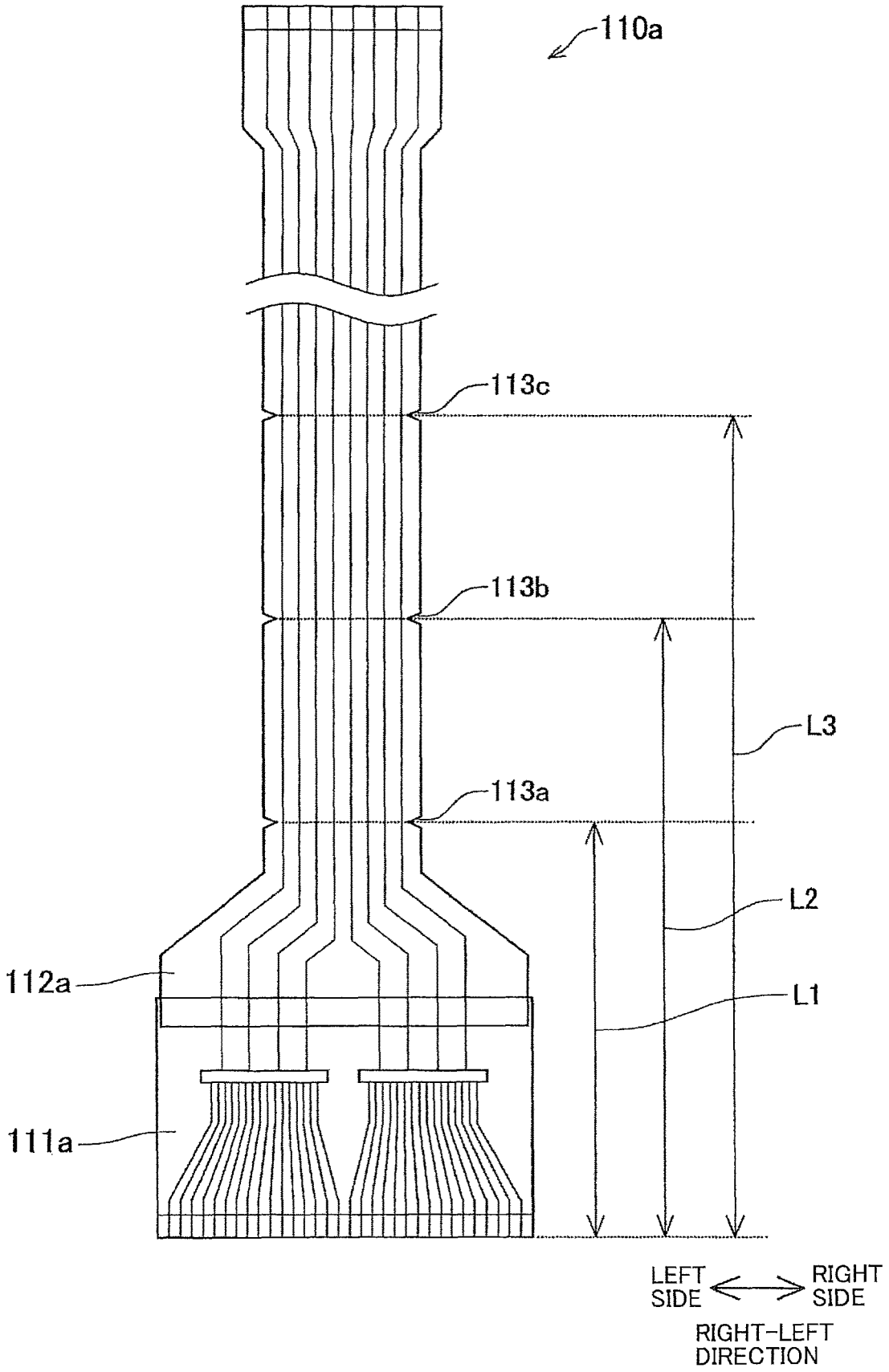
FIG. 8 is a plan view of a wiring member 110*a* in its extended state according to a second modification.

In a second modification, the head chip 21 and the board 28 are connected via wiring members 110*a*-110*d*, in place of the wiring members 30*a*-30*d*. Like the wiring members 30*a*-30*d*, the wiring members 110*a*-110*d* extend so as to be bent at respective bent portions and connect the head chip 21 and the board 28. As shown in FIG. 8, the wiring member 110*a* includes a COF board 111*a* similar to the COF board 51*a* and an FPC board 112*a*. In the FPC board 112*a*, notches 113*a*, 113*b*, 113*c* are formed. Specifically, the notches 113*a* are formed at a portion of the FPC board 112*a* which is distant by a length L1 in the extension direction of the wiring member 110*a* from a connected position at which the wiring member 110*a* is connected to the head chip 21*a* (i.e., one end of the COF board 111*a* opposite to another end thereof at which the COF board 111*a* is connected to FPC board 112*a*). The notches 113*b* are formed at a portion of the FPC board 112*a* which is distant by a length L2 in the extension direction from the connected position. The notches 113*c* are formed at a portion of the FPC board 112*a* which is distant by a length L3 in the extension direction from the connected position. The wiring members 110*b*-110*d* also have a structure similar to the wiring member 110*a*.

Figure 9A:
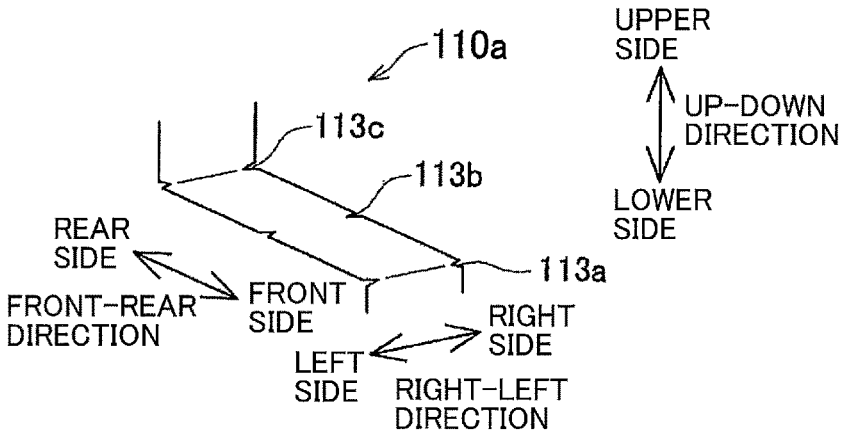
FIGS. 9A-9D are views showing bent states of the respective wiring members 110*a*-110*d* according to the second modification.

As shown in FIG. 9A, after extending in the up-down direction, the wiring member 110*a* is bent rearward at the portion in which the notches 113*a* are formed and which is distant from the connected position by the length L1. (This portion is one example of "first bent portion".) Further, after extending in the front-rear direction, the wiring member 110*a* is bent upward at the portion in which the notches 113*c* are formed and which is distant from the connected position by the length L3 (as one example of "first length).

Figure 9B:
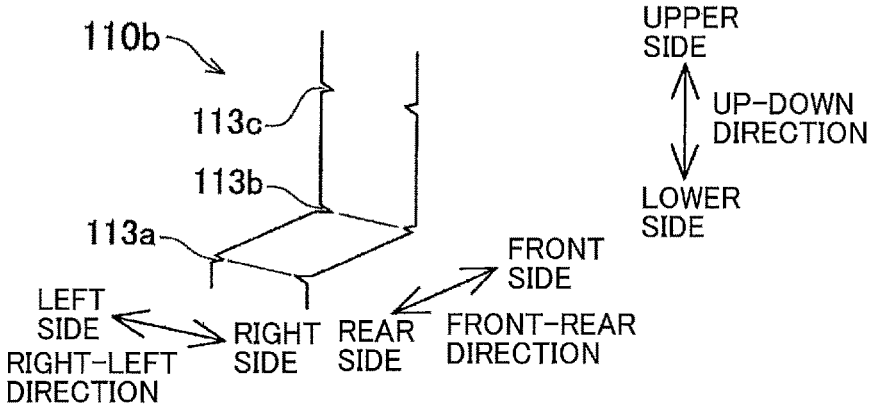

As shown in FIG. 9B, after extending in the up-down direction, the wiring member 110*b* is bent frontward at the portion in which the notches 113*a* are formed. Further, after extending in the front-rear direction, the wiring member 110*b* is bent upward at a portion of the FPC board 112*a* in which the notches 113*b* are formed and which is distant from the connected position by a length L2 (as one example of "second length"). This portion is one example of "second bent portion".

Figure 9C:
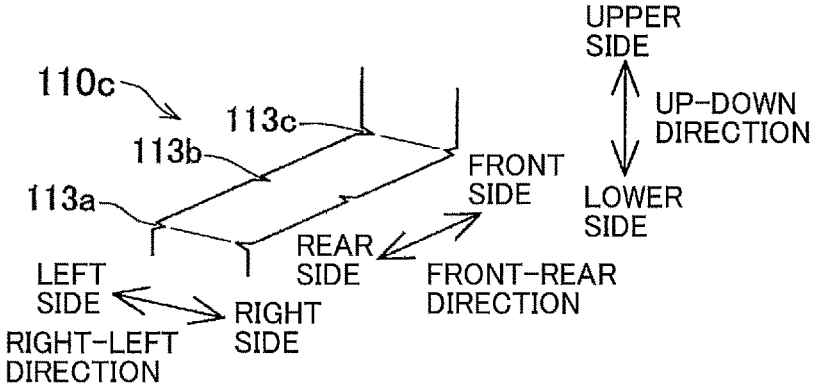

As shown in FIG. 9C, after extending in the up-down direction, the wiring member 110*c* is bent frontward at the portion in which the notches 113*a* are formed. Further, after extending in the front-rear direction, the wiring member 110*c* is bent upward at the portion in which the notches 113*c* are formed.

Figure 9D:
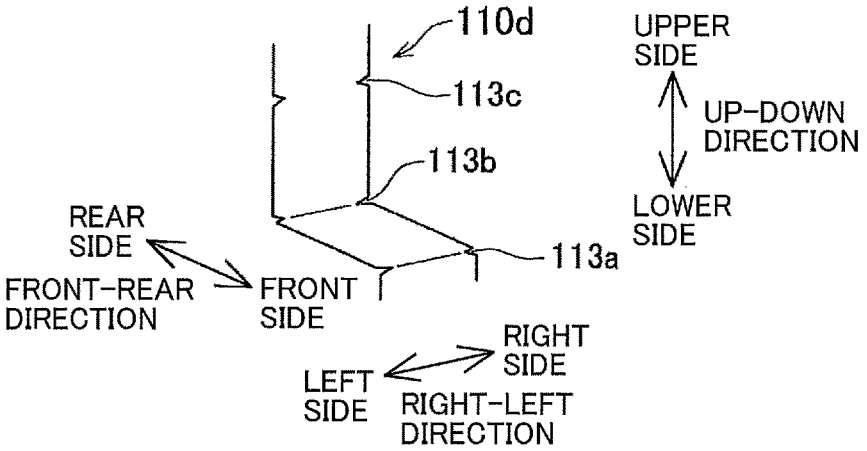

As shown in FIG. 9D, after extending in the up-down direction, the wiring member 110*d* is bent rearward at the portion in which the notches 113*a* are formed. Further, after extending in the front-rear direction, the wiring member 110*d* is bent upward at the portion in which the notches 113*b* are formed.

In the second modification, the notches 113*a*-113*c* are formed at the respective bent portions of the wiring members 110*a*-110*d*, whereby the wiring members 110*a*-110*d* are easily bent at the portions in which the notches 113*a*-133*d* are formed. In the second modification, the wiring members 110*a*-110*d* are constituted by respective wiring members having the same structure in which the notches are formed in both of: the portions to be bent when used as the wiring member 110*a*, 110*c* and the portions to be bent when used as the wiring member 110*b*, 110*d*. Thus, in an instance where each wiring member 110*a*-110*d* is constituted by the same wiring member, the wiring member is easily bent at the bent portions irrespective of whether the wiring member is used as any one of the wiring members 110*a*-110*d*.

In the second modification, the wiring members 110*a*-110*d* are bent upward immediately after drawn from the head chip 21, and are further bent frontward or rearward at substantially the same height position. Thus, in each of the wiring members 110*a*-110*d*, the portion that is bent in the front-rear direction corresponds to the portion which is distant by the length L1 from the connected position at which each wiring member 110*a*-110*d* is connected to the head chip 21.

In the wiring member 110*a*, the bent portion at which the wiring member 110*a* is bent rearward is located more frontward than the head unit 11*b*. The wiring member 110*a* extends from this bent portion to a more rearward position beyond the head unit 11 and is then bent upward. Similarly, in the wiring member 110*c*, the bent portion at which the wiring member 110*c* is bent frontward is located more rearward than the head unit 11*a*. The wiring member 110*c* extends from this bent portion to a more frontward position beyond the head unit 11*a* and is then bent upward. In contrast, in the wiring member 110*b*, the bent portion at which the wiring member 110*b* is bent frontward is located more frontward than the head unit 11*a*, and the wiring member 110*b* is then bent upward without passing between other adjacent two head units in the front-rear direction. Similarly, in the wiring member 110*d*, the bent portion at which the wiring member 110*d* is bent rearward is located more rearward than the head unit 11*b*, and the wiring member 110*d* is then bent upward without passing between other adjacent two head units in the front-rear direction. Thus, the length L3 between the upwardly bent portion and the connected position with the head chip 21 in the wiring members 110*a*, 110*c* which pass between other adjacent two head units in the front-rear direction is longer than the length L2 between the upwardly bent portion and the connected position in the wiring members 110*b*, 110*d* which do not pass between other adjacent two head units in the front-rear direction.

In view of the above, in the second modification, the wiring members 110*a*-110*d* are constituted by respective wiring members having mutually the same structure. That is, each wiring member has the notches 113*a* formed at the portion to be bent when used as any of the wiring members 110*a*-110*d*, the notches 113*b* formed at the portion to be bent when used as the wiring member 110*a*, 110*c* but not to be bent when used as the wiring member 110*b*, 110*d*, and the notches 113*c* formed at the portion to be bent when used as the wiring member 110*b*, 110*d* but not to be bent when used as the wiring member 110*a*, 110*c*.

In the second modification, all of the wiring members 110*a*-110*d* are constituted by respective wiring members having mutually the same structure. The structure may differ among the wiring members 110*a*-110*d*. For instance, the wiring member used as the wiring member 110*a*, 110*c* may have only the notches 113*a*, 113*c*, and the wiring member used as the wiring member 110*b*, 110*d* may have only the notches 113*a*, 113*b*.

Figure 10A:
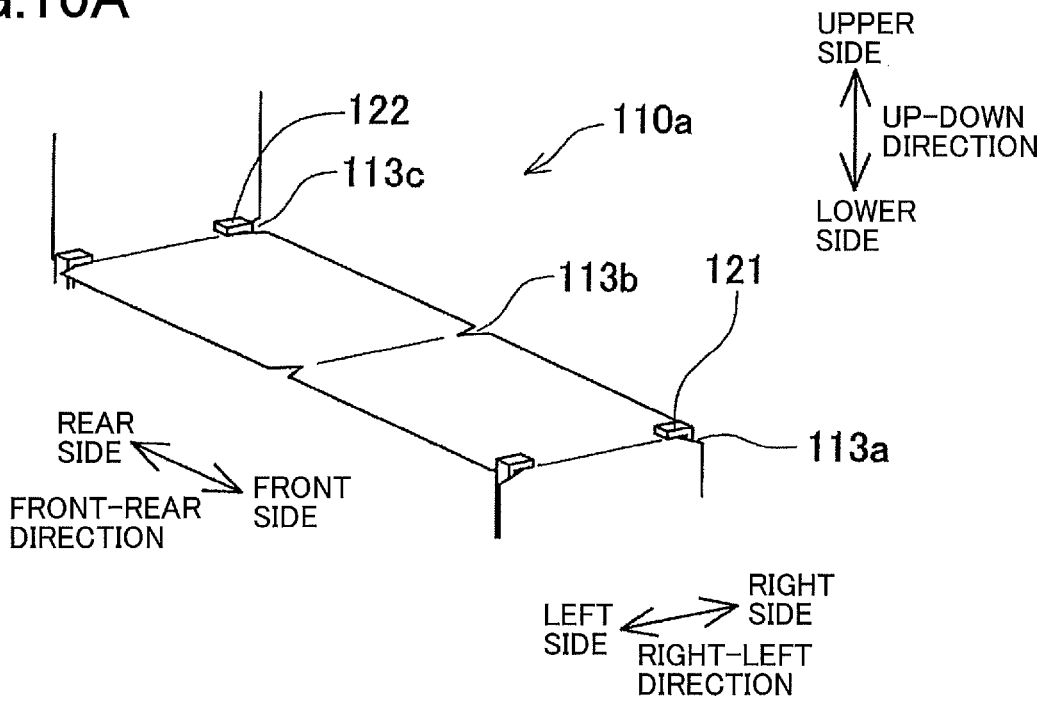
FIG. 10A is a view showing positions of hooks 121, 122 provided for engagement with notches of the wiring member 110*a* in a third modification, and FIG. 10B a view showing positions of hooks 123, 124 provided for engagement with notches of the wiring member 110*b* in the third modification.
Figure 10B:
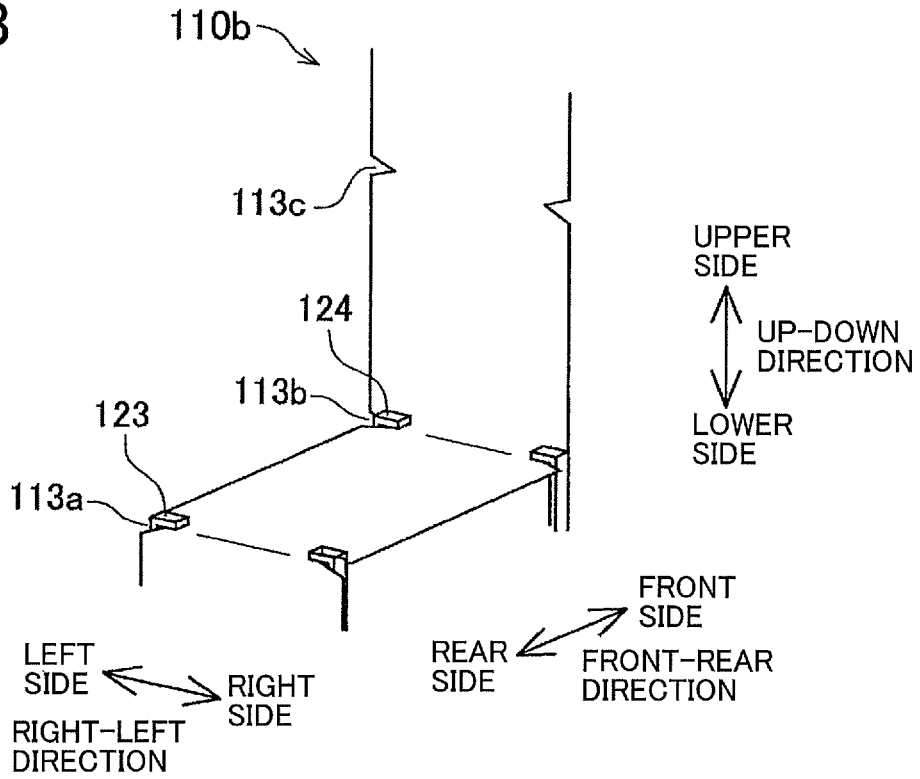

In a third modification, the printer includes hooks 121, 122 shown in FIG. 10A for engagement with the notches of the wiring member 110*a* of the second modification and hooks 123, 124 shown in FIG. 10B for engagement with the notches of the wiring member 110*b*. The printer further includes hooks similar to the hooks 121, 122 for engagement with the notches of the wiring member 110*c* and hooks similar to the hooks 123, 124 for engagement with the notches of the wiring member 110*d*. These hooks are provided at portions of the head units 11, the holder 12, the sub tank 24 in the printer, for instance.

The hooks 121 are to be held in engagement with the notches 113*a* of the wiring member 110*a* so as to fix, to the printer, the portion of the wiring member 110*a* in which the notches 113*a* are formed. The hooks 122 are to be held in engagement with the notches 113*c* of the wiring member 110*a* so as to fix, to the printer, the portion of the wiring member 110*a* in which the notches 113*c* are formed. The hooks 123 are to be held in engagement with the notches 113*a* of the wiring member 110*b* so as to fix, to the printer, the portion of the wiring member 110*b* in which the notches 113*a* are formed. The hooks 124 are to be held in engagement with the notches 113*b* of the wiring member 110*b* so as to fix, to the printer, the portion of the wiring member 110*a* in which the notches 113*b* are formed.

In the third modification, the wiring member 110*a* is fixed to the printer by the hooks 121, 122, whereby the wiring member 110*a* is prevented from being removed from the head chip 21*a* or the board 28 during transportation of the printer. Further, the wiring member 110*b* is fixed to the printer by the hooks 123, 124, whereby the wiring member 110*b* is prevented from being removed from the head chip 21*a* or the board 28 during transportation of the printer. The same applies to the wiring members 110*c*, 110*d*.

While, in third modification, the hooks 121, 122 are formed for the wiring member 110*a*, only one of the hooks 121 and the hooks 122 may be formed. Likewise, only one of the hooks 123 and the hooks 124 may be formed for the wiring member 110*b*.

In the illustrated embodiment, the board 28 is disposed above the ink-jet head 2, and the wiring members 30*a*-30*d* are bent upward so as to be connected to the connectors 29 of the board 28. This is not necessarily required. For instance, boards may be disposed respectively on the front side and the rear side of the ink-jet head 2, and the wiring members extending rearward from the head units 11*a*, 11*b* may be connected to the rear-side board while the wiring members extending frontward from the head units 11*a*, 11*b* may be connected to the front-side board.

In the illustrated embodiment, the two wiring members 30*a*, 30*b* are connected to the head unit 11*a* (the head chip 21*a*), and the two wiring members 30*c*, 30*d* are connected to the head unit 11*b* (the head chip 21*b*). This is not necessarily required.

Figure 11:
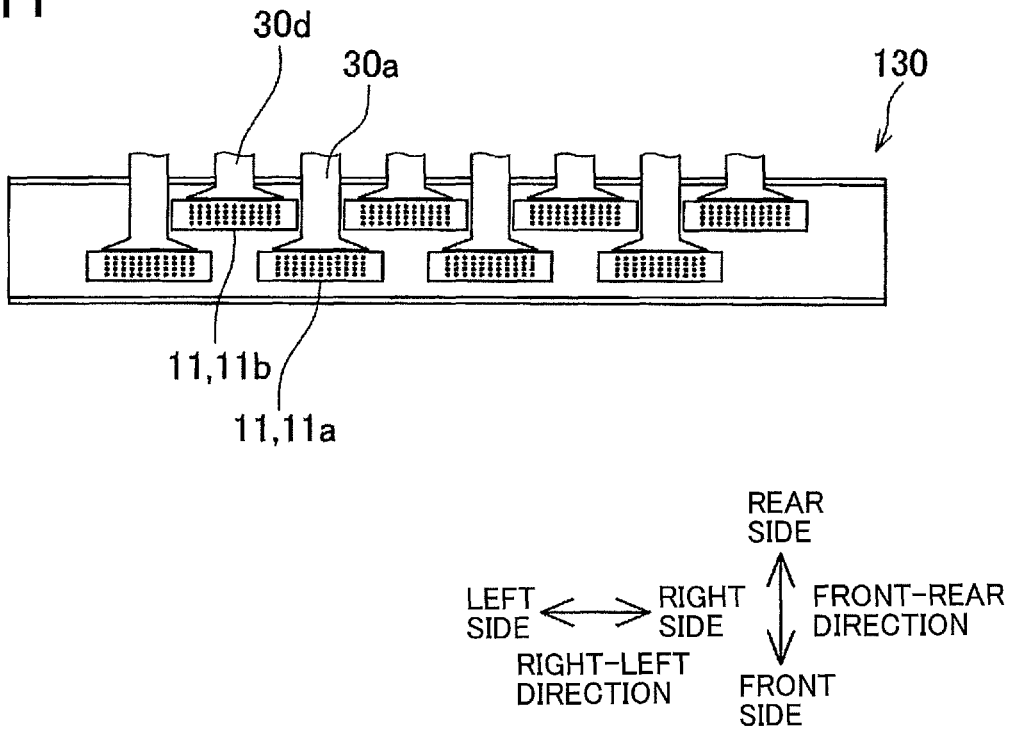
FIG. 11 is a schematic view of an ink-jet head 130 according to a fourth modification.

In an ink-jet head 130 according to a fourth modification shown in FIG. 11, only the wiring member 30*a* is connected to each head unit 11*a*, and the wiring member 30*b* (FIG. 1) is not connected. Further, only the wiring member 30*d* is connected to each head unit 11*b*, and the wiring member 30*c* (FIG. 1) is not connected. With this configuration, all of the wiring members connected to the plurality of head units 11 can be drawn toward only the rear side.

In contrast to the fourth modification, only the wiring member 30*b* may be connected to each head unit 11*a*, and only the wiring member 30*c* may be connected to each head unit 11*b*. With this configuration, all of the wiring members connected to the plurality of head units 11 can be drawn toward the front side. In the illustrated embodiment, the head unit 11*b* corresponds to "first head unit" and the head unit 11*a* corresponds to "second head unit". In the fourth modification, in contrast, the head unit 11*a* corresponds to "first head unit" and the head unit 11*b* corresponds to "second head unit".

Figure 12:
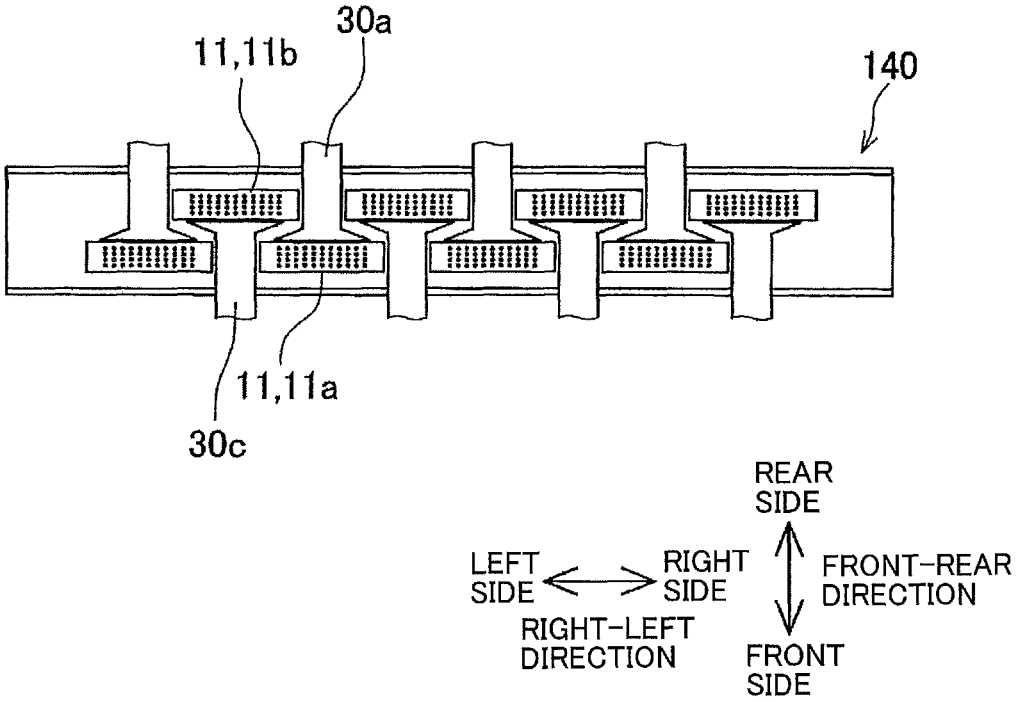
FIG. 12 is a schematic view of an ink-jet head 140 according to a fifth modification.

In an ink-jet head 140 according to a fifth modification shown in FIG. 12, only the wiring member 30*a* is connected to each head unit 11*a*, and the wiring member 30*b* (FIG. 1)

is not connected. Further, only the wiring member 30*c* is connected to each head unit 11*b*, and the wiring member 30*d* (FIG. 1) is not connected.

In the configuration above, the wiring members 30*a* are arranged in the right-left direction at a rear-side portion of the ink-jet head 140, and the wiring members 30*c* are arranged in the right-left direction at a front-side portion of the ink-jet head 140. In an instance where the connectors to be connected to the wiring members 30*a*-30*d* are provided at the opposite end portions of the board in the front-rear direction, this configuration ensures an increased pitch at which the connectors are arranged in the right-left direction. Thus, the cost and the size of the board can be reduced.

In the illustrated embodiment, the ink-jet head 2 includes the plurality of head units 11*a* which are arranged in the right-left direction so as to be spaced apart from each other by the spacing S and the plurality of head units 11*b* which are arranged in the right-left direction so as to be spaced apart from each other by the spacing S. This is not necessarily required. The ink-jet head may be configured such that the ink-jet head at least includes one head unit 11*a* and two adjacent head units 11*b* and such that a left end portion of a right-side one of the two head units 11*b* overlaps a right end portion of the head unit 11*a* in the front-rear direction and a right end portion of a left-side one of the two head units 11*b* overlaps a left end portion of the head unit 11*a* in the front-rear direction.

Alternatively, the ink-jet head may be configured such that the ink-jet head at least includes two adjacent head units 11*a* and one head unit 11*b* and such that a left end portion of a right-side one of the two head units 11*a* overlaps a right end portion of the head unit 11*b* in the front-rear direction and a right end portion of a left-side one of the two head units 11*a* overlaps a left end portion of the head unit 11*b* in the front-rear direction. In this case, the head unit 11*a* corresponds to "first head unit" and the head unit 11*b* corresponds to "second head unit", in contrast to the illustrated embodiment.

In the illustrated embodiment and modifications, the wiring member has the small-width portion for permitting the wiring member to pass through the spacing between two adjacent head units 11. This configuration may be modified as follows.

Figure 13A:
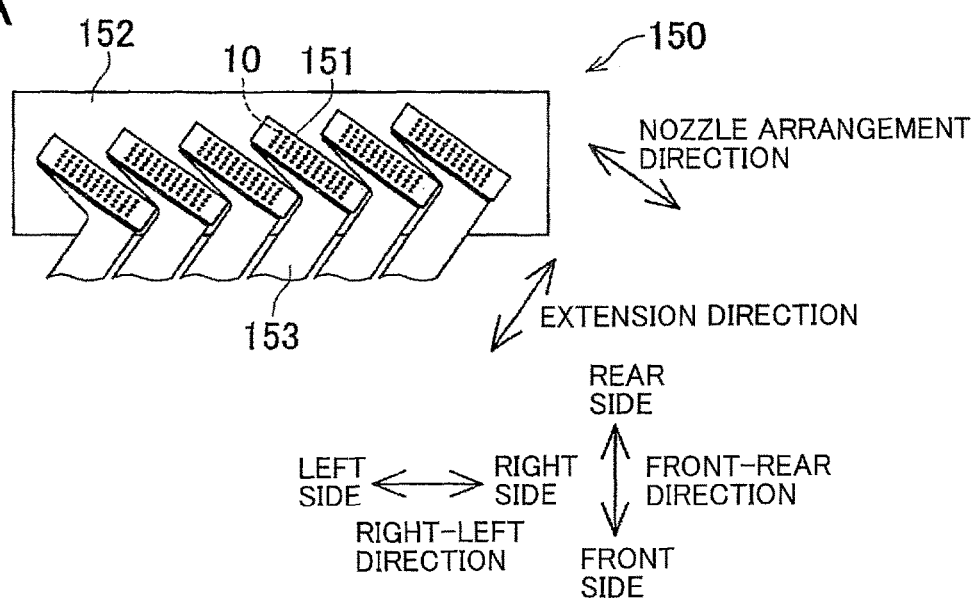
FIG. 13A is a schematic view of an ink-jet head 150 according to a sixth modification.

An ink-jet head 150 according to a sixth modification shown in FIG. 13A includes a plurality of head units 151 and a holder 152. The head units 151 are identical in structure with the head units 11 (FIG. 1). The head units 151 are arranged in one row in the right-left direction so as to be inclined with respect to the right-left direction such that a left side of a line along a nozzle arrangement direction (in which the nozzles 10 are arranged) is located on the rear side. The nozzle arrangement direction is one example of "first direction" and "predetermined direction". With this configuration, except one end portion of each head unit 151 located on one side in the nozzle arrangement direction, namely, except a right end portion thereof located on the front side, the head unit 151 overlaps another head unit 151 located adjacent thereto on the left side in a direction which is horizontal and which is orthogonal to the nozzle arrangement direction. The direction is one example of "extension direction" and "second direction". The holder 152 holds the head units 151 in this positional relationship.

Figure 13B:
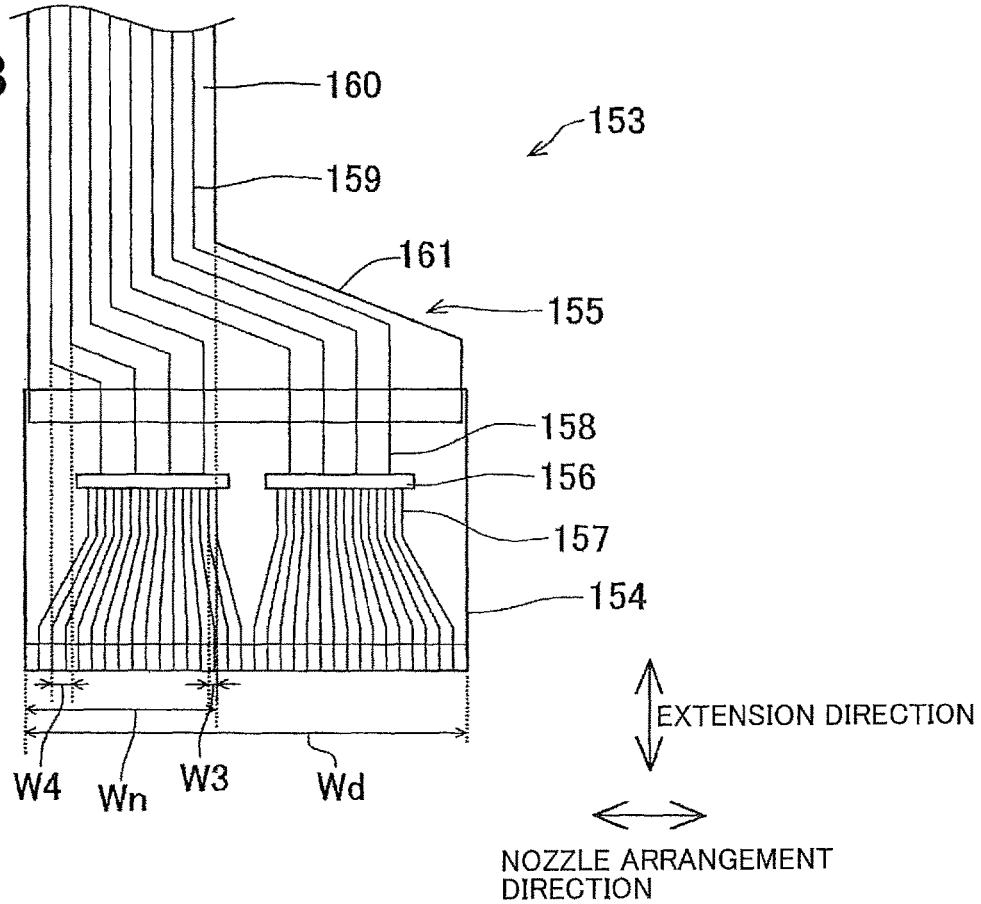
FIG. 13B is a plan view of a wiring member 153 in its extended state according to a sixth modification.

A wiring member 153 is connected to each head unit 151. As shown in FIGS. 13A and 13B, the wiring member 153 extends from the head unit 151 in the extension direction which is horizontal and which is orthogonal to the nozzle arrangement direction. The wiring member 153 is constituted by a COF board 154 (as one example of "first board") and an FPC board 155 (as one example of "second board"). The COF board 154 has a width Wd in the nozzle arrangement direction. On the COF board 154, two driver ICs 156 (each as one example of "drive circuit") are mounted. A longitudinal direction of the driver ICs 156 coincides with the nozzle arrangement direction. The two driver ICs 156 are arranged in the nozzle arrangement direction.

On the COF board 154, a plurality of individual wires 157 and a plurality of control wires 158 are formed. The individual wires 157 respectively correspond to the nozzles 10 and connect the two driver ICs 156 and the head unit 151 to each other. The number of the control wires 158 is smaller than that of the individual wires 157. The control wires 158 are connected to the driver ICs 156 so as to extend from the driver ICs 156 in a direction away from the head unit 151.

The FPC board 155 is connected to one end of the COF board 154 remote from the head unit 151. The FPC board 155 includes a plurality of control wires 159. The control wires 159 are respectively connected to the control wires 158. A minimum pitch W4 of the control wires 159 is larger than a minimum pitch W3 of the individual wires 157 of the COF board 154.

The FPC board 155 has a width in the nozzle arrangement direction substantially equal to the width Wd of the COF board 154 at and near its portion at which the FPC board 155 is connected to the COF board 154, namely, at and near a connection of the FPC board 155*a* and the COF board 154. The FPC board 155 has a tapered portion 161 located further from the COF board 154 than its portion having the width Wd. The tapered portion 161 has a width in the right-left direction which gradually decreases in a direction away from the COF board 154. The FPC board 155 has a small-width portion 160 located further from the COF board 154 than the tapered portion 161. The small-width portion 160 has a width Wn in the nozzle arrangement direction smaller than the width Wd. A center of the small-width portion 160 in the nozzle arrangement direction is shifted toward the one side (the front and right side) in the nozzle arrangement direction with respect to a center of the wiring member 153. The small-width portion 160 of the wiring member 153 connected to one head unit 151 passes through a space existing on the one side, in the nozzle arrangement direction, of another head unit 151 located adjacent to the head unit 151 on the left side. (The space is one example of "space existing next to the first head unit in the first direction). The small-width portion 160 which passes through the space extends in the extension direction beyond the adjacent head unit 151 while avoiding the adjacent head unit 151. One end of the FPC board 155 remote from the COF board 154 is connected to a board or the like (not shown).

In the sixth modification, The COF board 154 has the width Wd in the nozzle arrangement direction, and it is thus possible to provide a space for mounting the driver ICs 156 on the wiring member 153. In the sixth modification, the FPC board 155 has the small-width portion 160 having the width Wn in the nozzle arrangement direction smaller than the width Wd of the COF board 154. This configuration enables the wiring member 153 connected to one head unit 151 to pass through the space existing, on the one side, in the nozzle arrangement direction, of another head unit 151 located adjacent to the head unit 151 on the left side and to extend in the extension direction beyond the adjacent the head unit 151. In the sixth modification, when focusing on adjacent two of the plurality of head units 151 arranged in the right-left direction, a left-side one of the adjacent two head units 151 corresponds to "first head unit" while a right-side one of the adjacent two head units 151 corresponds to "second head unit".

Also in the sixth modification, the wiring member 153 is constituted by the COF board 154 and the FPC board 155 in which the minimum pitch of the wires provided thereon is larger than that in the COF board 154. Like the illustrated embodiment, this configuration reduces a production cost of the wiring member 153, as compared with a configuration in which the wiring member is constituted by a single wiring board. In the sixth modification, the wiring member 153 may be constituted by a single board.

In the sixth modification, the head unit 151 is disposed such that the nozzle arrangement direction is inclined with respect to the right-left direction. This is necessarily required. The ink-jet head may be otherwise constructed. For instance, the ink-jet head may include at least two head units in each of which the nozzle arrangement direction differs from that in the sixth modification and which are disposed so as to be shifted relative to each other in the first direction parallel to the nozzle arrangement direction and in the second direction orthogonal to the first direction. In this instance, the wiring member which is drawn from one of the two head units toward the other of the two head units in the second direction may be configured to include a large-width portion on which the driver ICs are mounted and a small-width portion having a smaller width in the first direction than the large-width portion. The small-width portion of the thus configured wiring member passes through a space existing next to the other head unit in the first direction and extends in the second direction toward one of opposite sides of the other head unit that is remote from the one head unit.

In the sixth modification, the ink-jet head 150 is a line head. This is not necessarily required. The present disclosure may be applied to the so-called serial head including a carriage configured to move in the right-left direction and a plurality of head units mounted on the carriage so as to be arranged in the front-rear direction.

In the ink-jet printer described above, the small-width portion of the wiring member drawn from one of the two head units toward the other of the two head units in the second direction extends beyond the other head unit in the second direction. This is not necessarily required. For instance, the small-width portion of the wiring member may extend to the space existing next to the other head unit in the first direction and may be bent upward in this space.

In the ink-jet printer described above, the small-width portion of the wiring member constitutes a part of the wiring member located further from the head chip 21 than the large-width portion in the extension direction of the wiring member. This is not necessarily required. The small-width portion may constitute a part of the wiring member located nearer to the head chip 21 than the large-width portion. For instance, the wiring member 30*a* of the illustrated embodiment may have the large-width portion at a position of the wiring member 30*a* located rearward of the head unit 11*b*, and the driver ICs may be mounted on the large-width portion.

While the present disclosure is applied to the ink-jet head configured to perform printing by ejecting the ink from the nozzles, the present disclosure is not limited to this configuration. For instance, the disclosure may be applied to other liquid ejection heads configured to eject, from the nozzles, a liquid other that than the ink.

What is claimed is:

1. A liquid ejection head, comprising:

a first head unit configured to eject a liquid from a plurality of nozzles arranged in a first direction;

a second head unit configured to eject the liquid from a plurality of nozzles arranged in the first direction, the second head unit being shifted with respect to the first head unit in both of the first direction and a second direction orthogonal to the first direction;

a sub tank connected in common to the first head unit and the second head unit to supply the liquid to the first head unit and the second head unit, a first wiring member having flexibility and drawn from the second head unit in the second direction toward the first head unit, the first wiring member extending in the second direction beyond the first head unit through a space existing next to the first head unit in the first direction; and a second wiring member having flexibility and drawn from the first head unit in the second direction toward the second head unit, the second wiring member extending in the second direction beyond the second head unit through a space existing next to the second head unit in the first direction, wherein no wiring members extend from one of opposite sides of the second head unit in the second direction that is remote from the first wiring member, and whereiin the first wiring member extends along the sub tank in a third direction that is a direction orthogonal to the first direction and the second direction ans away from the nozzles after extending from the second head unit in the second direction.

2. The liquid ejection head according to claim 1, wherein the first wiring member extends again in the second direction after extending in the third direction.

3. The liquid ejection head according to claim 1, comprising two first head units arranged in the first direction with a first space interposed therebetween, wherein the first wiring member extends through the first space.

4. The liquid ejection head according to claim 1, comprising two second head units arranged in the first direction with a second space interposed therebetween, wherein the second wiring member extends through the second space.

5. The liquid ejection head according to claim 1, wherein the first wiring member includes a drive circuit.

6. The liquid ejection head according to claim 1, wherein the first wiring member extends from the second head unit in the second direction without inclining relative to the second direction.

* * * * *